US010792211B2

(12) United States Patent
Murakami et al.

(10) Patent No.: US 10,792,211 B2
(45) Date of Patent: Oct. 6, 2020

(54) ASSIST DEVICE, ASSIST METHOD, AND RECORDING MEDIUM

(71) Applicant: Panasonic Intellectual Property Management Co., Ltd., Osaka (JP)

(72) Inventors: Kenta Murakami, Osaka (JP); Stephen John, Nara (JP); Mayumi Komatsu, Kyoto (JP); Jun Ozawa, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 553 days.

(21) Appl. No.: 15/693,896

(22) Filed: Sep. 1, 2017

(65) Prior Publication Data

US 2018/0092794 A1 Apr. 5, 2018

(30) Foreign Application Priority Data

Oct. 5, 2016 (JP) ..... 2016-197629

(51) Int. Cl.
*A61H 1/00* (2006.01)
*A61H 3/00* (2006.01)
*A61H 1/02* (2006.01)

(52) U.S. Cl.
CPC ..... *A61H 3/00* (2013.01); *A61H 1/0244* (2013.01); *A61H 1/0262* (2013.01);
(Continued)

(58) Field of Classification Search
CPC ..... A61H 3/00; A61H 1/0244; A61H 1/0262; A61H 2001/0248; A61H 2001/0251; A61H 2003/007; A61H 2201/0192; A61H 2201/1215; A61H 2201/1223; A61H 2201/149; A61H 2201/163;
(Continued)

(56) References Cited

U.S. PATENT DOCUMENTS 10,524,973 B2 * 1/2020 Sodeyama ..... B25J 13/085
2003/0120183 A1 * 6/2003 Simmons ..... G06F 3/011 600/595

(Continued)

FOREIGN PATENT DOCUMENTS

JP 2014-133121 7/2014
JP 2016-047004 4/2016
WO WO-2013019749 A1 * 2/2013 ..... A63B 21/0058
WO 2014/109799 7/2014

*Primary Examiner* — Tu A Vo
(74) *Attorney, Agent, or Firm* — Wenderoth, Lind & Ponack, L.L.P.

(57) ABSTRACT

An assist device includes an upper-body belt attached to the upper body of a user, first and second belts attached to the knees, a first wire coupling the upper-body belt to the first belt, a second wire crossing the first wire, a third wire coupling the upper-body belt to the second belt, a fourth wire crossing the third wire, and a motor coupled to one end of each of the first to fourth wires. When assisting users with walking, tensions equal to a first threshold value or greater are applied to one of the first and second wires and one of the third and fourth wires by the motor at different times. When detecting slacking of the upper-body belt, tensions equal to the first threshold value or greater are simultaneously applied to one of the first and second wires and one of the third and fourth wires by the motor.

10 Claims, 30 Drawing Sheets

(52) U.S. Cl.
CPC ..... *A61H 2001/0248* (2013.01); *A61H 2001/0251* (2013.01); *A61H 2003/007* (2013.01); *A61H 2201/0192* (2013.01); *A61H 2201/1215* (2013.01); *A61H 2201/1223* (2013.01); *A61H 2201/149* (2013.01); *A61H 2201/163* (2013.01); *A61H 2201/165* (2013.01); *A61H 2201/1642* (2013.01); *A61H 2201/1652* (2013.01); *A61H 2201/5007* (2013.01); *A61H 2201/5038* (2013.01); *A61H 2201/5079* (2013.01); *A61H 2201/5084* (2013.01); *A61H 2201/5097* (2013.01); *A61H 2205/088* (2013.01); *A61H 2205/102* (2013.01)

(58) Field of Classification Search
CPC ..... A61H 2201/1642; A61H 2201/165; A61H 2201/1652; A61H 2201/5007; A61H 2201/5038; A61H 2201/5079; A61H 2201/5084; A61H 2201/5097; A61H 2205/088; A61H 2205/102; B25J 9/0006; B25J 9/104; B25J 9/1694
See application file for complete search history.

(56) References Cited

U.S. PATENT DOCUMENTS

2013/0288863 A1 10/2013 Yamamoto et al.
2014/0163435 A1* 6/2014 Yamamoto ..... A61H 3/00 601/35
2014/0277739 A1* 9/2014 Kornbluh ..... B25J 9/1633 700/260
2014/0296761 A1* 10/2014 Yamamoto ..... A61H 1/0244 602/23
2015/0173993 A1* 6/2015 Walsh ..... B25J 9/0006 414/4
2015/0190249 A1* 7/2015 Ishibashi ..... A61H 3/00 623/24
2015/0342819 A1 12/2015 Shimada et al.
2016/0107309 A1* 4/2016 Walsh ..... A61H 3/00 248/550
2016/0184111 A1* 6/2016 Ikedo ..... A61F 2/68 623/27
2016/0184166 A1* 6/2016 Takenaka ..... A61H 3/00 623/27
2016/0235615 A1* 8/2016 Yamamoto ..... A61H 3/00
2017/0027735 A1* 2/2017 Walsh ..... A61F 5/0102
2017/0202724 A1* 7/2017 De Rossi ..... A61H 3/00

* cited by examiner

ASSIST DEVICE, ASSIST METHOD, AND RECORDING MEDIUM

BACKGROUND

1. Technical Field

The present disclosure relates to an assist device, an assist method, and a recording medium that assist a person with motion.

2. Description of the Related Art

Japanese Unexamined Patent Application Publication No. 2014-133121 describes an auxiliary device that detects the posture of a user with, for example, a sensor, determines the compression force of a corset that varies in accordance with the posture, and controls the compression force.

SUMMARY

However, according to the existing technique described in Japanese Unexamined Patent Application Publication No. 2014-133121, it is difficult to effectively detect slacking of the belt.

One non-limiting and exemplary embodiment provides an assist device that assists a person with motion by using wires and that is capable of effectively detecting slacking of a belt of the assist device.

In one general aspect, the techniques disclosed here feature an assist device including an upper-body belt to be attached to an upper body of a user, a first belt to be attached to a right knee of the user, a second belt to be attached to a left knee of the user, a first wire that couples the upper-body belt to the first belt, a second wire that couples the upper-body belt to the first belt, where the second wire crosses the first wire, a third wire that couples the upper-body belt to the second belt, a fourth wire that couples the upper-body belt to the second belt, where the fourth wire crosses the third wire, a motor coupled to a first end of the first wire, a terminal end of the second wire, a terminal end of the third wire, and a terminal end of the fourth wire, and a drive controller that (i) causes the motor to apply a first tension greater than or equal to a first threshold value to one of the first wire and the second wire at a first time and a second tension greater than or equal to the first threshold value to one of the third wire and the fourth wire at a second time different from the first time when the assist device assists the user with walking and (ii) causes the motor to apply a third tension greater than or equal to the first threshold value to one of the first wire and the second wire at a third time and a fourth tension greater than or equal to the first threshold value to one of the third wire and the fourth wire at the third time when the assist device detects slacking of the upper-body belt.

According to the present disclosure, slacking of the belt of the assist device can be effectively detected.

It should be noted that general or specific embodiments may be implemented as a system, a method, an integrated circuit, a computer program, a computer-readable storage medium or any selective combination thereof. Examples of a computer-readable storage medium include a nonvolatile storage medium, such as a compact disc-read only memory (CD-ROM).

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
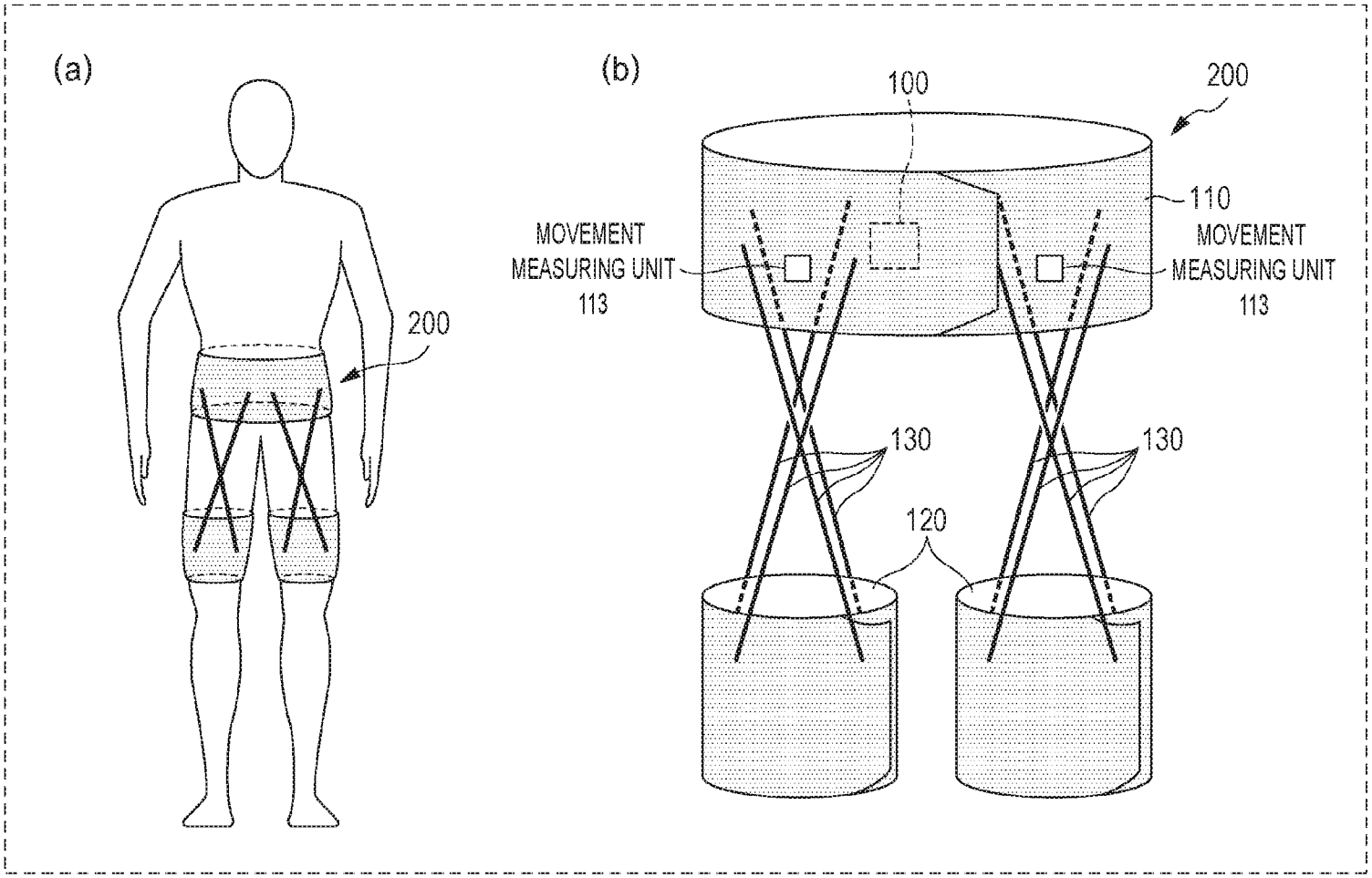
FIG. 1 is a schematic illustration of an assist device used by a user according to an exemplary embodiment.

Underlying Knowledge Forming Basis of the Present Disclosure

The present inventor found that the following situation occurs when using the auxiliary device described in "Background Art".

In the auxiliary device described in Japanese Unexamined Patent Application Publication No. 2014-133121, slacking of the belt that occurs when the auxiliary device is attached is measured by measuring the compression force by moving the attached actuator. Thereafter, the belt is constricted on the basis of the measurement value. However, the auxiliary device does not measure the displacement of the belt position caused by the slack. Consequently, the auxiliary device cannot prevent the positional displacement of the belt caused by slacking of the belt.

Thus, according to the present disclosure, to effectively detect slacking of the belt of the assist device, the present inventor conceived the idea of the improvement described below.

According to an aspect of the present disclosure, an assist device includes an upper-body belt to be attached to an upper body of a user, a first belt to be attached to a right knee of the user, a second belt to be attached to a left knee of the user, a first wire that couples the upper-body belt to the first belt, a second wire that couples the upper-body belt to the first belt, where the second wire crosses the first wire, a third wire that couples the upper-body belt to the second belt, a fourth wire that couples the upper-body belt to the second belt, where the fourth wire crosses the third wire, a motor coupled to a first end of the first wire, a terminal end of the second wire, a terminal end of the third wire, and a terminal end of the fourth wire, and a drive controller that (i) causes the motor to apply a first tension greater than or equal to a first threshold value to one of the first wire and the second wire at a first time and a second tension greater than or equal to the first threshold value to one of the third wire and the fourth wire at a second time different from the first time when the assist device assists the user with walking and (ii) causes the motor to apply a third tension greater than or equal to the first threshold value to one of the first wire and the second wire at a third time and a fourth tension greater than or equal to the first threshold value to one of the third wire and the fourth wire at the third time when the assist device detects slacking of the upper-body belt.

In this manner, the assist device that assists a person with motion by using wires can effectively detect, for example, slacking of the upper-body belt of the assist device.

In addition, the assist device may further include a gyro sensor disposed in the upper-body belt and a controller, where the gyro sensor measures the angular velocity about the vertical axis of the user. The gyro sensor may measure the angular velocity when a tension greater than or equal to the first threshold value is applied to one of the first wire and the second wire at a fourth time and one of the third wire and the fourth wire at the fourth time, and the controller may output information indicating that the upper-body belt is slack if the angular velocity is greater than or equal to a second threshold value.

In this manner, the assist device that assists a person with motion by using wires can effectively detect, for example, slacking of the upper-body belt of the assist device. In addition, the assist device can present the result of detection to, for example, the user. Thus, the assist device can prompt the user to tighten the belt that is slack. As a result, the user can be assisted by the assist device with more effective assist force.

In addition, the first wire may be parallel to the third wire, and the second wire may be parallel to the fourth wire. When the assist device detects the slacking, the drive controller may causes the motor to apply the third tension to the first wire at the third time and the fourth tension to the third wire at the third time or apply the third tension to the second wire at the third time and the fourth tension to the fourth wire at the third time.

In this manner, since a force can be applied to the upper body belt in the rotational direction, slacking of the upper body belt can be effectively detected.

In addition, the assist device may further include a fifth wire that couples the upper-body belt to the first belt, a sixth wire that couples the upper-body belt to the first belt, where the sixth wire crosses the first wire, a seventh wire that couples the upper-body belt to the second belt, and an eighth wire that couples the upper-body belt to the second belt, where the eighth wire crosses the seventh wire. The first wire, the second wire, the third wire, and the fourth wire may be located on the front side of the user, and the fifth wire, the sixth wire, the seventh wire, and the eighth wire may be located on the rear side of the user. The first wire may be parallel to each of the third wire, the fifth wire, and the seventh wire, and the second wire may be parallel to each of the fourth wire, the sixth wire, and the eighth wire. The assist device may assist the user with one of adduction and abduction of a leg of the user by performing any one of the following operations:

(a1) the controller causes the motor to apply a tension greater than or equal to the first threshold value to each of the first wire and the fifth wire, (a2) the controller causes the motor to apply a tension greater than or equal to the first threshold value to each of the second wire and the sixth wire, (a3) the controller causes the motor to apply a tension greater than or equal to the first threshold value to each of the third wire and the seventh wire, and (a4) the controller causes the motor to apply a tension greater than or equal to the first threshold value to each of the fourth wire and the eighth wire.

In this manner, the assist device can easily assist the user with adduction or abduction of the legs of the user.

In addition, the assist device may assist the user with one of internal rotation and external rotation of the leg by performing any one of the following operations:

(b1) the controller causes the motor to apply a tension greater than or equal to the first threshold value to each of the first wire and the sixth wire, (b2) the controller causes the motor to apply a tension greater than or equal to the first threshold value to each of the second wire and the fifth wire, (b3) the controller causes the motor to apply a tension greater than or equal to the first threshold value to each of the third wire and the eighth wire, and (b4) the controller causes the motor to apply a tension greater than or equal to the first threshold value to each of the fourth wire and the seventh wire.

In this manner, the assist device can easily assist the user with one of internal rotation and external rotation of the legs of the user.

In addition, the first wire has the first end and the second end. The motor may be disposed in the upper-body belt. The second end may be fixed to the first belt. The upper-body belt may include a supporter that slidably supports the first wire, and a first portion of the first wire located between the first end and the supporter may extend in a longitudinal direction of the upper-body belt. When the slacking of the upper-body belt is detected, a force is applies to the first portion by using the motor.

In this manner, since a force can be effectively applied to the upper body belt in the rotational direction, slacking, for example, of the upper body belt can be effectively detected.

It should be noted that these general or specific aspects may be implemented as a method, an integrated circuit, a computer program, a computer-readable storage medium, such as a compact disc-read only memory (CD-ROM), or any selective combination thereof.

An assist device according to an aspect of the present disclosure is described in detail below with reference to the accompanying drawings.

Note that each of the exemplary embodiments described below is a particular example of the present disclosure. A value, a shape, a material, a constituent element, the positions and the connection form of the constituent elements, steps, and the sequence of steps described in the exemplary embodiments are only examples and shall not be construed as limiting the scope of the present disclosure. In addition, among the constituent elements in the exemplary embodiments described below, the constituent element that does not appear in an independent claim, which has the broadest scope, is described as an optional constituent element.

Exemplary Embodiments

According to an assist device of the present exemplary embodiment, when the user wears an upper-body belt unit and knee belt units of the assist device on the body or when the user stops moving after wearing the units, the assist device determines whether each of the knee belt units is slack by using the value output from at least one of an acceleration sensor and a gyro sensor and presents information regarding the determination result to the user. The assist device having such a configuration is described below.

1-1. Configuration

An assist device 200 according to the present exemplary embodiment is described below with reference to the accompanying drawings.

Figure 2:
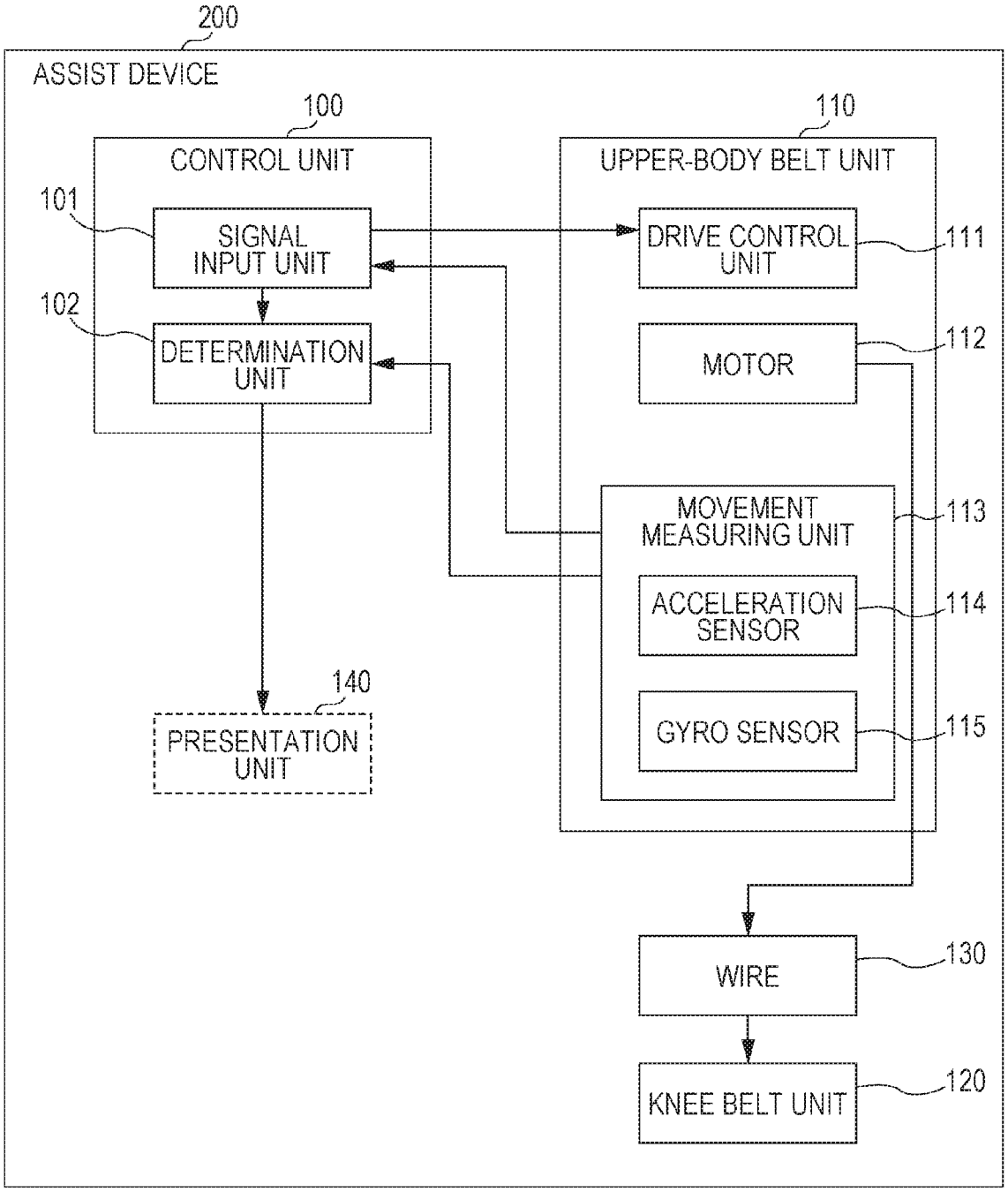
FIG. 2 is a block diagram of the configuration of the assist device according to the exemplary embodiment.

FIG. 1 is a schematic illustration of how the assist device 200 according to the present exemplary embodiment is used by a user. FIG. 2 is a block diagram of the configuration of the assist device according to the present exemplary embodiment.

As illustrated in FIG. 1 and FIG. 2, the assist device 200 includes a control unit 100, an upper-body belt unit 110 serving as an upper-body belt, knee belt units 120 serving as first and second belts, and wires 130. The assist device 200 may further include a presentation unit 140 that presents, to the user, information about the fit of the belts determined by the control unit 100.

The control unit 100 includes a signal input unit 101 and a determination unit 102. The control unit 100 is disposed, for example, in the upper-body belt unit 110. The control unit 100 may be disposed in the knee belt unit 120.

The signal input unit 101 generates a calibration signal for detecting slacking of the upper-body belt unit 110.

The determination unit 102 determines the fit of the upper-body belt unit 110 around the upper body of the user by using the measurement result of a movement measuring unit 113 included in the upper-body belt unit 110. More specifically, when a first tension is applied to each of the wires 130 by motors 112, the determination unit 102 determines whether the angular velocity measured by a gyro sensor 115 of the movement measuring unit 113 is greater than or equal to a second threshold value. If, as a result of the determination, the angular velocity measured by the gyro sensor 115 is greater than or equal to the second threshold value, the determination unit 102 outputs information indicating that the upper-body belt unit 110 is slack and/or displaced. The upper-body belt unit 110 being slack refers to a situation where the upper-body belt unit 110 is not firmly fixed to the user and, thus, moves relative to the waist of the user when a tension is applied to the upper-body belt unit 110 by the wires 130. In addition, the upper-body belt unit 110 being displaced refers to a situation where the upper-body belt unit 110 is rotated about the vertical axis of the upper body, in either one of two rotational directions, from a predetermined position of the waist of the user (the position at which two wires 130 connected to one of the knee belt units 120 are appropriately aligned in the front-rear direction) and is located at a position other than the predetermined position.

The control unit 100 is implemented by, for example, a processor that executes a predetermined program and a memory that stores the predetermined program. Alternatively, the control unit 100 may be implemented by a dedicated circuit.

The upper-body belt unit 110 includes a drive control unit 111, the motors 112, and a movement measuring unit 113. As illustrated in FIG. 1(*a*), the upper-body belt unit 110 serves as a harness attached to the upper body (for example, the waist) of the user. Examples of the user's upper body include the waist and the shoulders. In this system, by pulling the wire, the upper-body belt unit is pulled in the vertical downward direction (toward the knee belt units). At this time, if, for example, the upper-body belt unit is on the waist, slippage of the belt can be prevented by the pelvis. In the case of the upper-body belt unit being on the shoulders, the upper-body belt unit can be fixed on the shoulders if the user carries the upper-body belt unit on the shoulders like a backpack, for example.

The upper-body belt unit 110 has, for example, an elongated band shape. The upper-body belt unit 110 is wound around the waist of the user and is kept fastened onto the waist by a fastener, such as a hook and loop fastener. In this manner, the upper-body belt unit 110 is attached to the waist of the user. For example, to brace the user, the upper-body belt unit 110 is made of a non-stretchable material that is less likely to be deformed even when tension is applied.

The drive control unit 111 controls driving of the motors 112 in accordance with a received signal. Each of the motors 112 is connected to one of the wires 130. The motors 112 are driven by the drive control unit 111. Thus, each of the motors 112 pulls the wire 130 and releases tension on the wire 130. The motors 112 are fixed at predetermined positions of the upper-body belt unit 110. Each of the motors 112 is provided for one of the eight wires 130 (according to the present exemplary embodiment, eight motors 112) and is connected to one of the eight wires 130.

The upper-body belt unit 110 may have a tubular shape. In such a case, the circumferential length of the tubular shape is longer than the circumferential length of the waist portion of the user. Accordingly, the upper-body belt unit 110 in this case has an adjustment mechanism for adjusting the circumferential length to the circumference of the waist of the user. An example of the adjustment mechanism is a hook and loop fastener. The hook-and-loop fastener is disposed on the outer circumference of the tube such that a part of the hook-and-loop fastener having hooks branch from the outer circumference of the tube, and a part of the hook and loop fastener having loops is arranged on the outer circumference of the tube.

Figure 19:
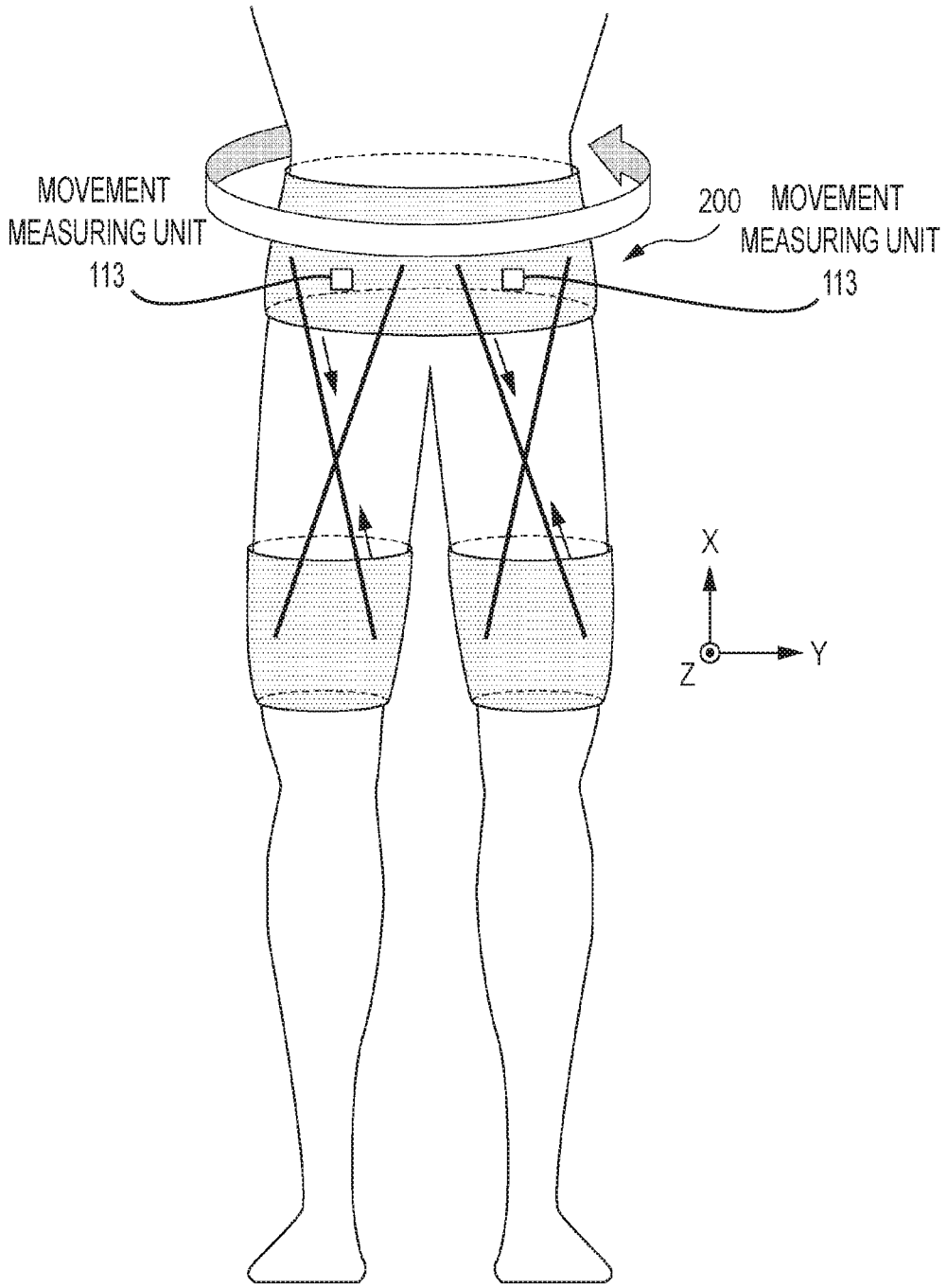
FIG. 19 illustrates a method for determining whether the upper-body belt unit is slack by using a determination unit.

The movement measuring unit 113 is disposed in the upper-body belt unit 110 and measures the movement of the upper-body belt unit 110. More specifically, the movement measuring unit 113 includes an acceleration sensor 114 and a gyro sensor 115. The acceleration sensor 114 measures the accelerations in three different directions of the upper-body belt unit 110, that is, in the X-axis direction, the Y-axis direction, and the Z-axis direction, and the gyro sensor 115 measures the angular velocities around the three different axes, that is, the X-axis, the Y-axis, and the Z-axis. The X-axis, the Y-axis, and the Z-axis are defined as illustrated in FIG. 19. That is, the gyro sensor 115 is disposed in the upper-body belt unit 110 to measure the angular velocity in the longitudinal direction of the upper-body belt unit 110 (that is, the circumferential direction of the tubular upper-body belt unit 110 as viewed in the X-axis direction). The movement measuring unit 113 transmits the measurement result to the determination unit 102 of the control unit 100. The movement measuring unit 113 may be further disposed in each of the knee belt units 120 and measure the movement of the knee belt units 120. In this way, the movement measuring unit 113 may measure the movement of the user. By aligning the mark written on the upper-body belt unit 110 with the mark written on the movement measuring unit 113 or the gyro sensor 115 and attaching the movement measuring unit 113 or the gyro sensor 115 to the upper-body belt unit 110, the X-axis, the Y-axis, and the Z-axis of the gyro sensor 115 may be made coincident with the X-axis, the Y-axis, and the Z-axis of the gyro sensor 115 in the coordinate system of an object to be measured, respectively. By aligning the mark written on the upper-body belt unit 110 with a mark written on the movement measuring unit 113 or the acceleration sensor 114 and attaching the movement measuring unit 113 or the acceleration sensor 114 to the upper-body belt unit 110, the X-axis, the −Y axis, and the −Z-axis of the acceleration sensor 114 may be made coincident with the X-axis, the Y-axis, and the Z-axis of the acceleration sensor 114 in the coordinate system of an object to be measured, respectively.

The wires 130 connect the upper-body belt unit 110 to the knee belt units 120. More specifically, the wires 130 connect the motors 112 and the knee belt units 120. Four of the wires 130 are disposed for each of the knee belt units 120, and two of the four wires 130 that cross each other are disposed on the front side of the knee belt units 120, and the other two that cross each other are disposed on the rear side of the knee belt units 120. Each of the wires 130 has a first end and a second end. The first end is connected to the motor 112. When the motor 112 is disposed in the upper-body belt unit 110, the second end is connected to the knee belt unit 120.

Like the upper-body belt unit 110, the knee belt unit 120 has, for example, an elongated band shape. The knee belt unit 120 is attached to the thigh or the upper knee of the user. The knee belt unit 120 need not be attached to the hip joint. The thigh of a human being has a characteristic that its size gradually increases from the knee to the buttocks. Accordingly, by attaching the knee belt on the upper knee (or the lower thigh), slippage caused by pulling the wires is reduced when the knee belt is tightly attached. Thus, the assist device can assist the user efficiently. For example, the knee belt unit 120 is a member that is wound around the thigh of the user and remains wound around the thigh by a fixing member, such as a hook and loop fastener or any other type of fastener. The knee belt units 120 are made of a non-stretchable material that is less likely to be deformed even when a tension is applied in order to support the user. According to the present exemplary embodiment, the assist device 200 includes two knee belt units 120 each corresponding to one of the two legs of the user. That is, the assist device 200 includes the knee belt unit 120 to be attached to the right knee of the user and the knee belt unit 120 to be attached to the left knee of the user.

As described above, the upper-body belt unit 110 and the knee belt units 120 are made of a non-stretchable material. Accordingly, when each of the knee belt units 120 has no slack and is attached to the leg of the user so as to conform to the shape of the leg, the assist device 200 can easily transfer the support force. Thus, the assist device 200 can assist the user efficiently.

The presentation unit 140 presents, to the user, the determination result of the determination unit 102 of the control unit 100. That is, the presentation unit 140 presents, to the user, at least one of whether the knee belt unit 120 is slack and whether the knee belt unit 120 is displaced.

Figure 3:
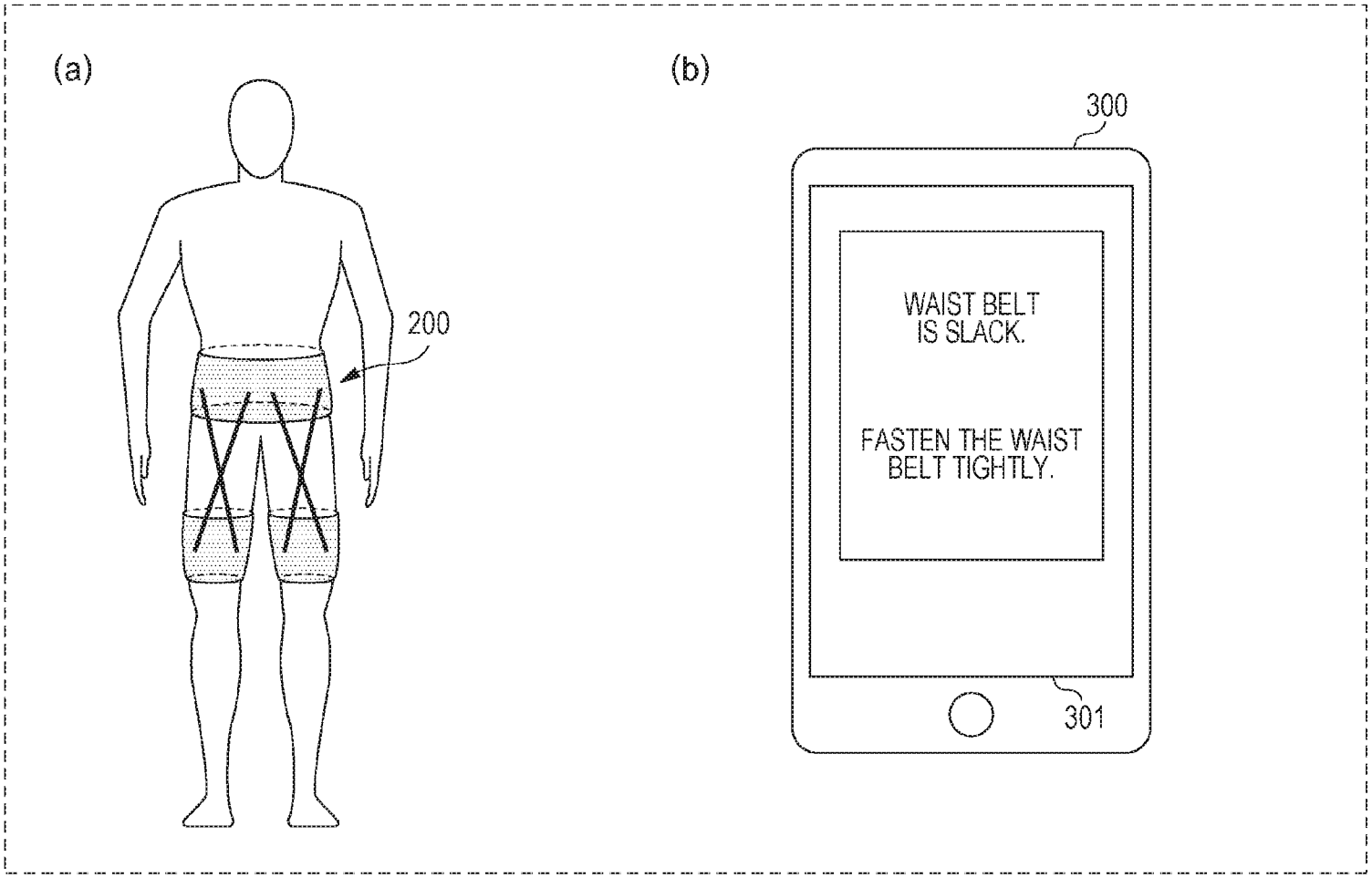
FIG. 3 illustrates an example of a method for presenting information to a user when the user uses an assist device.

FIG. 3 illustrates an example of an information presentation method employed when the user uses the assist device.

If the upper-body belt unit 110 attached to the user is slack, the presentation unit 140 presents to the user that the upper-body belt unit 110 is slack. For example, as illustrated in FIG. 3(*a*), the presentation unit 140 may be formed from a vibration actuator (not illustrated) that is disposed on the upper-body belt unit 110 and that informs the user that the upper-body belt unit 110 is slack by using vibration. Alternatively, for example, the presentation unit 140 may be formed from a vibration actuator that is disposed on the knee belt unit 120 and that informs the user that the upper-body belt unit 110 is slack by using vibration. Still alternatively, as illustrated in FIG. 3(*b*), the presentation unit 140 may display, on a display 301 of a mobile terminal 300 carried by the user, such as a smartphone, an image or a text message indicating that the upper-body belt unit 110 is slack.

Figure 4:
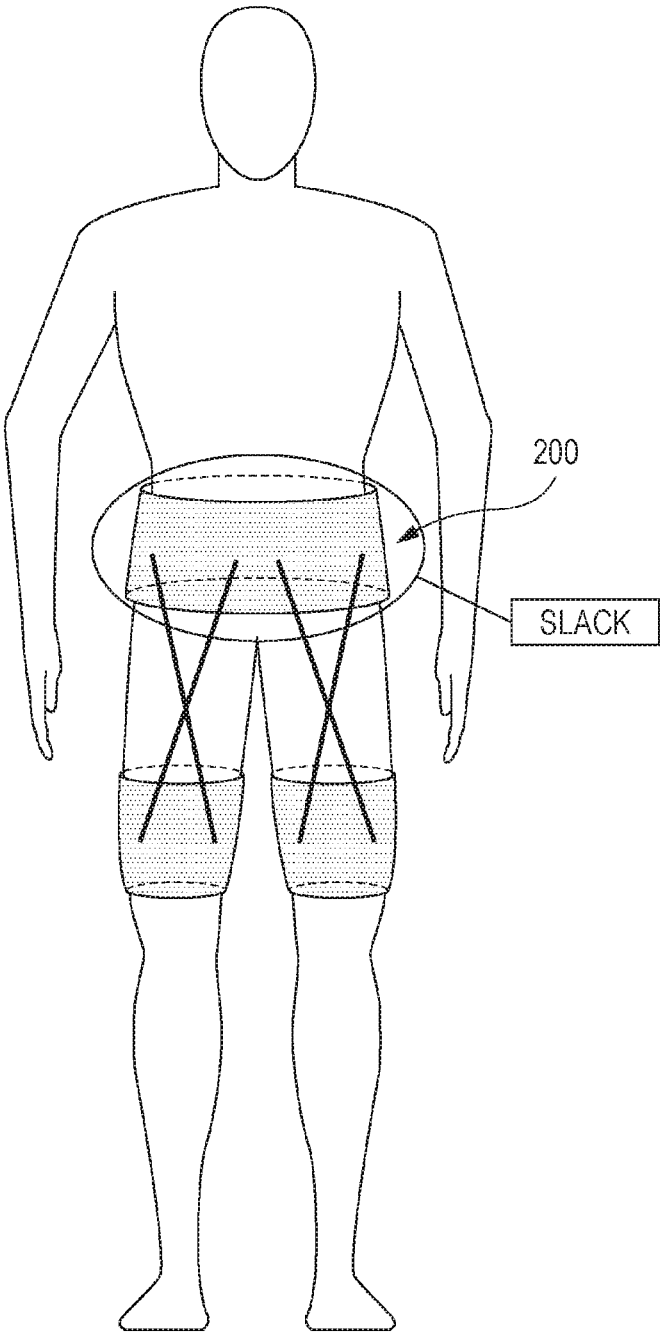
FIG. 4 illustrates an example of a method for assisting a user by controlling wires disposed so as to cross each other and a method for detecting slacking.

FIG. 4 illustrates an example of a method for assisting a user by controlling wires disposed so as to cross each other and a method for detecting the slack.

Among the four wires 130 connected from the upper-body belt unit 110 to the knee belt units 120 so as to cross each other, the upper-body belt unit 110 pulls a predetermined wire 130 at a predetermined time point. Thus, the assist device 200 assists the user with motion. For example, for a time period of 0.3 seconds after the start of the swing phase, two of the wires 130 disposed on the front side of the user for the knee belt unit 120 attached to the leg in the swing phase are pulled at the same time. In this manner, the assist device 200 assists the user with flexion of the hip joint of the leg. The assist device 200 has eight wires 130 disposed so as to be controllable in total. Two of the wires 130 are arranged to cross each other on each of the right and left legs and on each of the front and rear sides of the legs. Accordingly, while the user is walking, the assist device 200 can assist the user with flexion and the extension of the hip joint by alternately pulling the two wires 130 on each of the left and right legs and on each of the front and rear side of the legs. Note that the assist device 200 need not simultaneously pull the two wires 130 disposed to cross each other on each of the legs on each of the front and rear side. For example, the assist device 200 may select one of the two wires 130 disposed on the front side of a given leg and select one of the two wires 130 disposed on the rear side of the leg. In this manner, the assist device 200 may assist the user with movement other than flexion and the extension (e.g., abduction, adduction, external rotation, or internal rotation).

Furthermore, as illustrated in FIG. 4, if the attached upper-body belt unit 110 is slack, the upper-body belt unit 110 moves and, thus, the entire assist force is not applied. However, since the upper-body belt unit 110 stops at the iliac bone, the vertical acceleration of the user is less likely to vary greatly. Instead, in the upper-body belt unit 110, by applying a tension that promotes rotation in the left-right rotational direction via the wires 130, the angular velocity in the rotational direction is readily changed and, thus, the upper-body belt unit 110 easily comes off if the upper-body belt unit 110 is slack. As illustrated in FIG. 4, according to the assist device 200, for example, to detect the displacement, among two wires 130 disposed on the front side of each of the legs of the user, by pulling the wires 130 that extend in the same direction (waist: right→knee: left) (one end on the waist is located on the right, and the other end on the knee is located on the left), a variation in angular velocity of the upper-body belt unit 110 about the X-axis occurs. Thus, slacking of the upper-body belt unit 110 can be detected.

Accordingly, to detect slacking of the upper-body belt unit 110 after the assist device 200 is attached to the user, a calibration signal is input. In response to the input calibration signal, predetermined ones of the wires 130 are pulled. In this manner, the upper-body belt that is slack is rotated. Thereafter, the variations of the acceleration and the speed are evaluated by using the acceleration sensor 114 and the gyro sensor 115 disposed in the upper-body belt unit 110. In this way, it is detected whether the upper-body belt unit 110 is slack. In addition, the assist device 200 detects whether the upper-body belt unit 110 is displaced from a predetermined attachment position by evaluating the angular velocity detected by the gyro sensor 115. That is, if, as a result of input of the calibration signal, the assist device 200 determines that the upper-body belt unit 110 is displaced from the predetermined attachment position, the assist device 200 determines that the upper-body belt unit 110 is slack.

In this manner, the assist device 200 detects whether the upper-body belt unit 110 is slack and outputs the detection result. Accordingly, the user can easily notice that the upper-body belt unit 110 is slack after, for example, the user wears the assist device 200 by themselves or after the user wears the assist device 200 and operates the assist device 200 for a while. Consequently, by re-tightening the upper-body belt unit 110, the user can be more effectively assisted in moving both legs by the assist device 200.

The constituent elements in the functional block illustrated in FIG. 2 are described in more detail below.

1-1-1. Signal Input Unit

When the user wears the assist device 200, the signal input unit 101 determines a signal for detecting whether the upper-body belt unit 110 is slack or a signal for selecting a wire to be used for assistance during walking and sends the determined signal to the drive control unit 111. More specifically, at the time of calibration, the signal input unit 101 selects the wires 130 to be pulled in order to rotate the upper-body belt unit 110 and determines the tension to be applied to the selected wires 130. Thereafter, the signal input unit 101 determines the rotation angle of the motor for generating the tension as an input signal and sends the signal to the drive control unit 111. In addition, at the time of assistance, the signal input unit 101 identifies the walking phase by using a given point in time during walking (e.g., the time point when the heel contacts the ground) and determines a signal for pulling the wires in directions in which the hip joint of the user is flexed and extended in accordance with the identified walking phase. In this manner, the upper-body belt unit 110 assists the user with walking.

Figure 5:
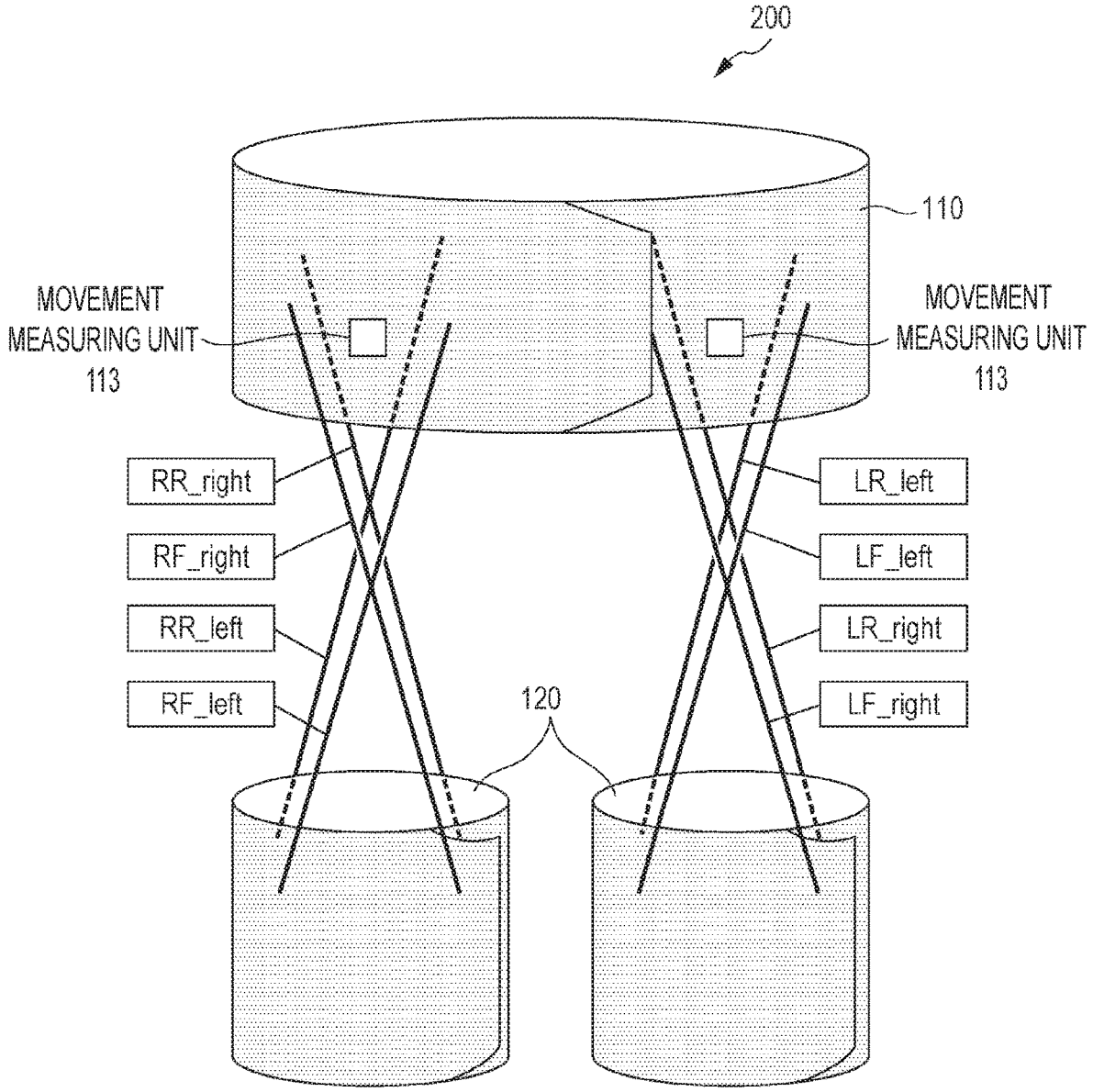
FIG. 5 illustrates eight wires arranged in the assist device.

FIG. 5 illustrates the eight wires arranged in the assist device.

As illustrated in FIG. 5, in the assist device 200, four wires 130 are connected between the upper-body belt unit 110 and each of the right and left knee belt units 120 (at four places in total) such that two of the wires 130 are disposed on the front side and the other two on the rear side and the two wires on each of the front and rear sides cross each other. To distinguish the wires from one another, the naming rule of the wires is "right/left leg-front/rear of the leg-attachment position of the upper-body belt unit". For example, "RF_right" represents the wire that is disposed for the right leg (Right) on the front side (Front) and is attached to the right side (right) of the upper body belt. In addition, "LR_left" represents the wire that is disposed for the left leg (Left) on the rear side (Rear) and is attached to the left side (left) of the upper body belt. In the similar manner, the eight wires, every two of which cross each other, are labeled as "RF_right", "RF_left", "RR_right", "RR_left", "LF_right", "LF_left", "LR_right", and "LR_left".

That is, the assist device 200 includes first to fourth wires. The first wire connects the upper-body belt unit 110 to the knee belt unit 120 that corresponds to the right knee. The second wire connects the upper-body belt unit 110 to the knee belt unit 120 that corresponds to the right knee and that crosses the first wire. The third wire connects the upper-body belt unit 110 and the knee belt unit 120 that corresponds to the left knee. The fourth wire connects the upper-body belt unit 110 to the knee belt unit 120 that corresponds to the left knee and that crosses the third wire. The first to fourth wires are disposed on the front face (front side) of the user.

The assist device 200 further includes fifth to eighth wires. The fifth wire connects the upper-body belt unit 110 to the knee belt unit 120 that corresponds to the right knee. The sixth wire connects the upper-body belt unit 110 and the knee belt unit 120 that corresponds to the right knee and that crosses the first wire. The seventh wire connects the upper-body belt unit 110 to the knee belt unit 120 corresponding to the left knee. The eighth wire connects the upper-body belt unit 110 to the knee belt unit 120 that corresponds to the left knee and that crosses the third wire. The fifth to eighth wires are disposed on the rear face (rear side) of the user.

In addition, the first wire, the third wire, the fifth wire, and the seventh wire are disposed parallel to one another. For example, the first wire is "RF_right", the third wire is "LF_right", the fifth wire is "RR_right", and the seventh wire is "LR_right".

In addition, the second wire, the fourth wire, the sixth wire, and the eighth wire are disposed parallel to one another. For example, the second wire is "RF_left", the fourth wire is "LF_left", the sixth wire is "RR_left", and the eighth wire is "LR_left".

The term "parallel" used herein is not intended to mean "strictly parallel". That is, the wires are parallel to one another if the wires are oriented in the same direction with respect to the X-axis direction.

An assist method and a calibration method are described below by using the above-described style of expression. The motion of the hip joint of the user in the assist method is described first.

Figure 6:
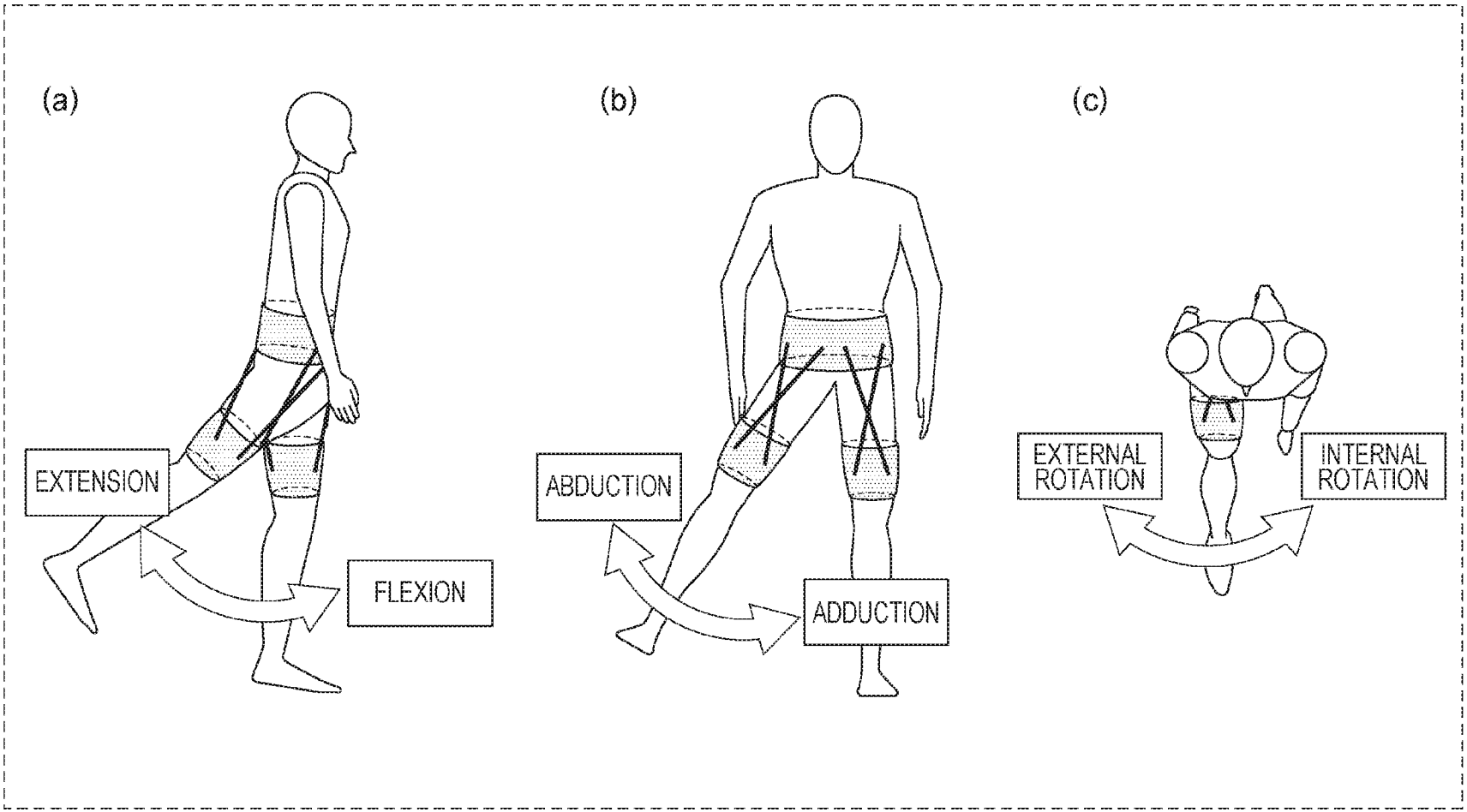
FIG. 6 illustrates the movements of the hip joint of a user that can be assisted by the assist device.

FIG. 6 illustrates the types of movement of the hip joint of the user that can be assisted by the assist device 200.

FIG. 6(*a*) illustrates flection and extension to move the thigh of the user in the forward-rearward direction. As illustrated in FIG. 6(*a*), the movement to move the thigh in the forward direction is called flexion of the hip joint, and the movement to move the thigh in the rearward direction is referred to as extension of the hip joint.

FIG. 6(*b*) illustrates abduction and adduction which move the thighs of the user in the right-left direction. As illustrated in FIG. 6(*b*), "moving the thighs outwardly" in the right-left direction of the user (the right side in the case of the right leg, and the left side in the case of the left leg) is called abduction, and "moving the thighs inwardly" in the right-left direction of the user (the left side in the case of the right leg, and the right side in the case of the left leg) is called adduction.

FIG. 6(*c*) illustrates external rotation and internal rotation to rotate the thigh of the user about the vertical axis of the user. As illustrated in FIG. 6(*c*), "rotating the thigh of the user externally" (right turn in the case of the right leg, and left turn in the case of the left leg) is called external rotation, and "rotating the thigh of the user internally" (in the left turn in the case of the right leg, and the right turn in the case of the left leg) is called the internal rotation.

When assisting the user with walking, the assist device assists the user with the following movements in the following ranges:

Assistance in the flexion direction: 20% to 60%

Assistance in the extension direction: 0% to 20%, 80% to 100%

Assistance in the abduction rotation direction: 0% to 55%

Assistance in the adduction direction: 60% to 100% (assistance is not needed during normal walking)

Assistance in the external rotation direction: 0% to 20%, 55% to 70%

Assistance in the internal rotation direction: 30% to 55%.

The assist signals input from the signal input unit 101 are sequentially described first.

Figure 7:
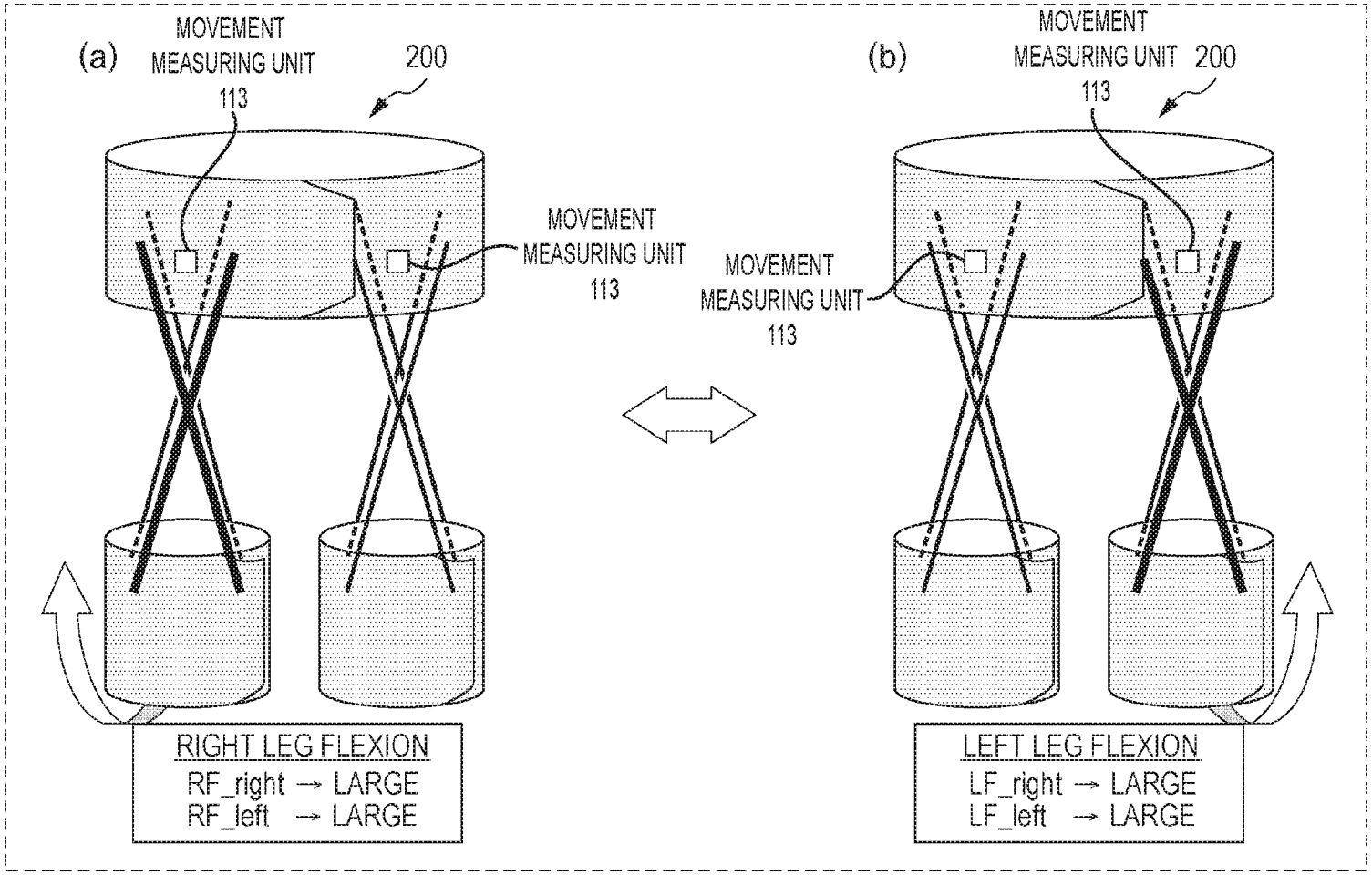
FIG. 7 illustrates assistance during flexion of the hip joint of a user.

FIG. 7 illustrates the case of assist in the flexion direction of the hip joint of the user.

FIG. 7(*a*) illustrates the assist in the flexion direction of the right hip joint, and FIG. 7(*b*) illustrates the assist in the flexion direction of the left hip joint. When assisting the leg with movement in the flexion direction of the right leg hip joint, the tension of each of the wires "RF_right" and "RF_left" is set to a value greater than or equal to a first threshold (for example, 100 N). Similarly, when assisting the leg with movement in the flexion direction of the left hip joint, the tension of each of the wires "LF_right" and "LF_left" is set to a value greater than or equal to the first threshold value.

Figure 8:
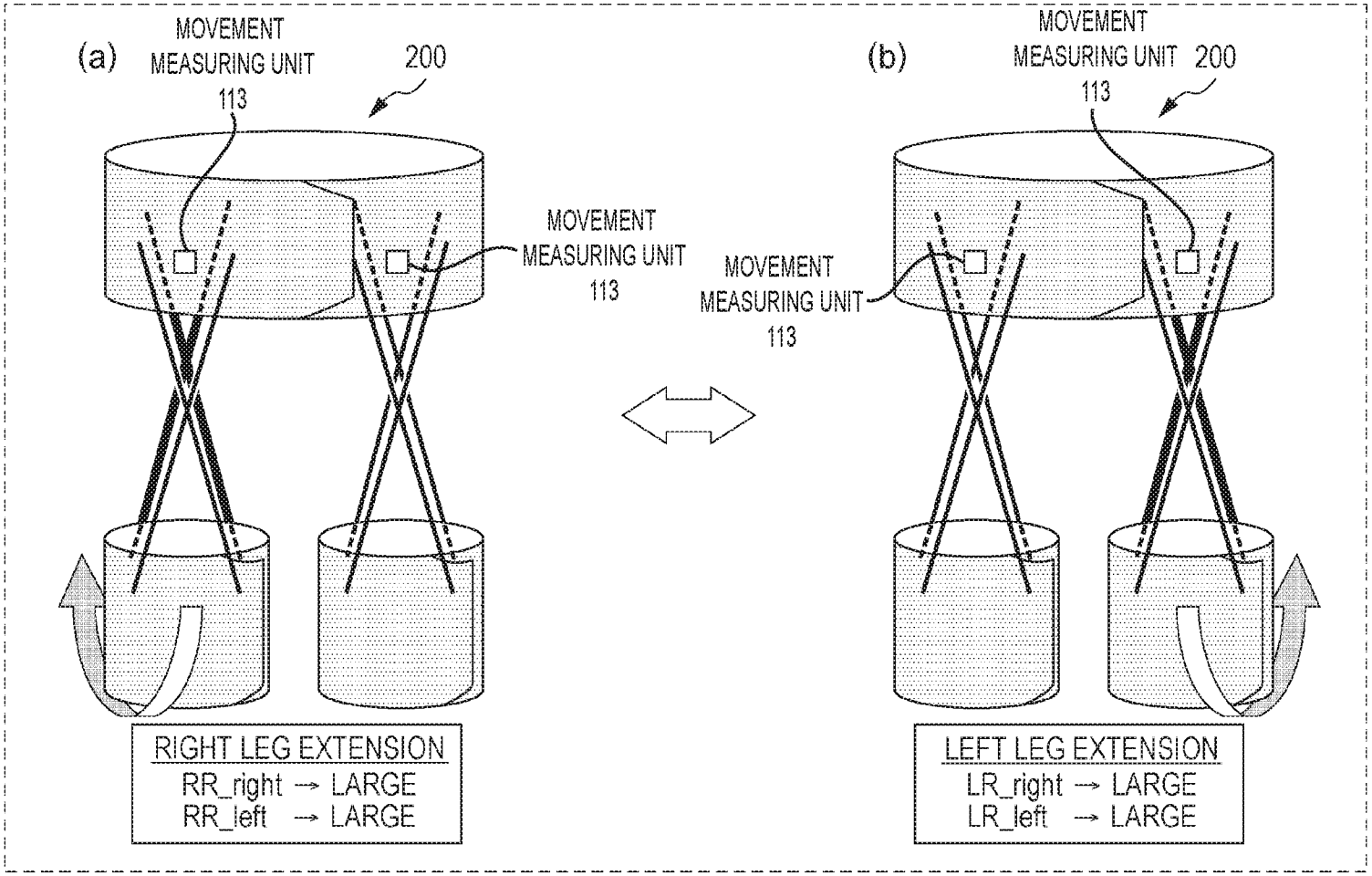
FIG. 8 illustrates assistance during extension of the hip joint of a user.

FIG. 8 illustrates the case of assist in the extension direction of the hip joint of the user.

Like the assist in the flexion direction, in assist in the extension direction of the right hip joint, each of the tensions of the wires "RR_right" and "RR_left" is set to a value greater than or equal to a first threshold value (for example, 100 N). In assist in the extension direction of the right hip joint, each of the tensions of the wires "LR_right" and "LR_left" is set to the value greater than or equal to a first threshold value. As described above, in assisting the hip joint of the user with walking, assistance is provided in the flexion direction and the extension direction. As a result, energy metabolism of the user can be reduced and, thus, the assist device can have an assist function. That is, when assisting the user with walking, the motor 112 applies a tension that is greater than or equal to the first threshold value to one of the first wire and the second wire and one of the third wire and the fourth wire at different points in time. The term "different points in time" used herein refers to points in time that make the time periods during which the tension greater than or equal to the first threshold is applied do not overlap each other. In other words, the condition that the tension greater than or equal to the first threshold value is applied to one of the first wire and the second wire and one of the third wire and the fourth wire at different points in time is equivalent to the condition that a tension greater than or equal to the first threshold value is not applied to one of the third wire and the fourth wire for the period of time during which a tension greater than or equal to the first threshold value is being applied to one of the first wire and the second wire and a condition that a tension greater than or equal to the first threshold value is not applied to one of the first wire and the second wire for the period of time during which a tension greater than or equal to the first threshold value is being applied to one of the third wire and the fourth wire.

Furthermore, by providing assistance in the abduction/adduction direction and the external-rotation/internal-rotation direction of the hip joint during the user's walking, the effect of assistance during walking can be further improved.

Figure 9:
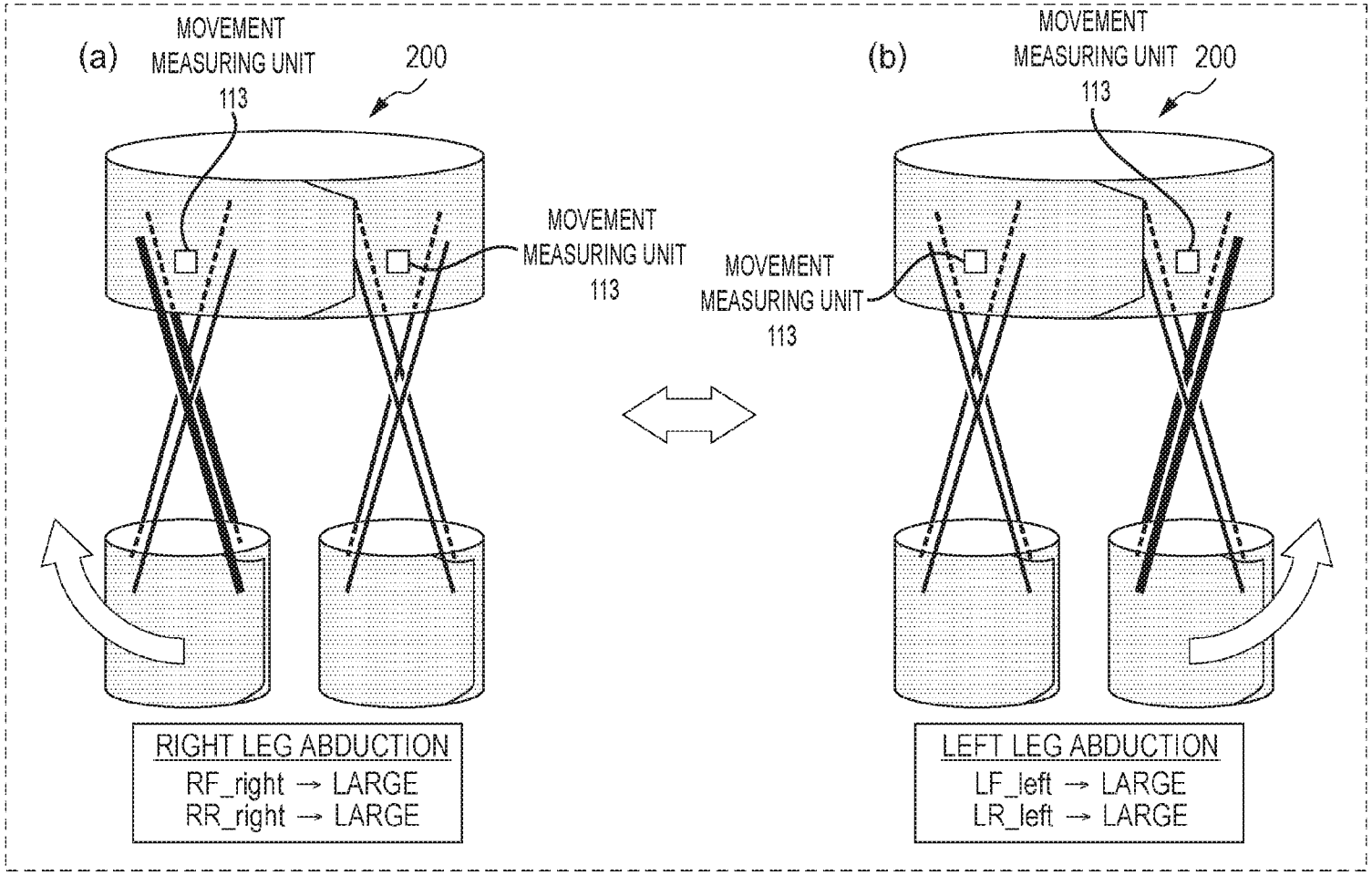
FIG. 9 illustrates assistance during abduction of the hip joint of a user.

FIG. 9 illustrates the case of assistance of the abduction of the hip joint of the user.

As illustrated in FIG. 9(*a*), when assistance is provided during the abduction of the hip joint of the right leg, the tension of each of the wires "RF_right" and "RR_right" is set to a value greater than or equal to the first threshold value. Similarly, when assistance is provided during the abduction of the hip joint of the left leg, the tension of each of the wires "LF_left" and "LR_left" is set to a value greater than or equal to the first threshold value.

Figure 10:
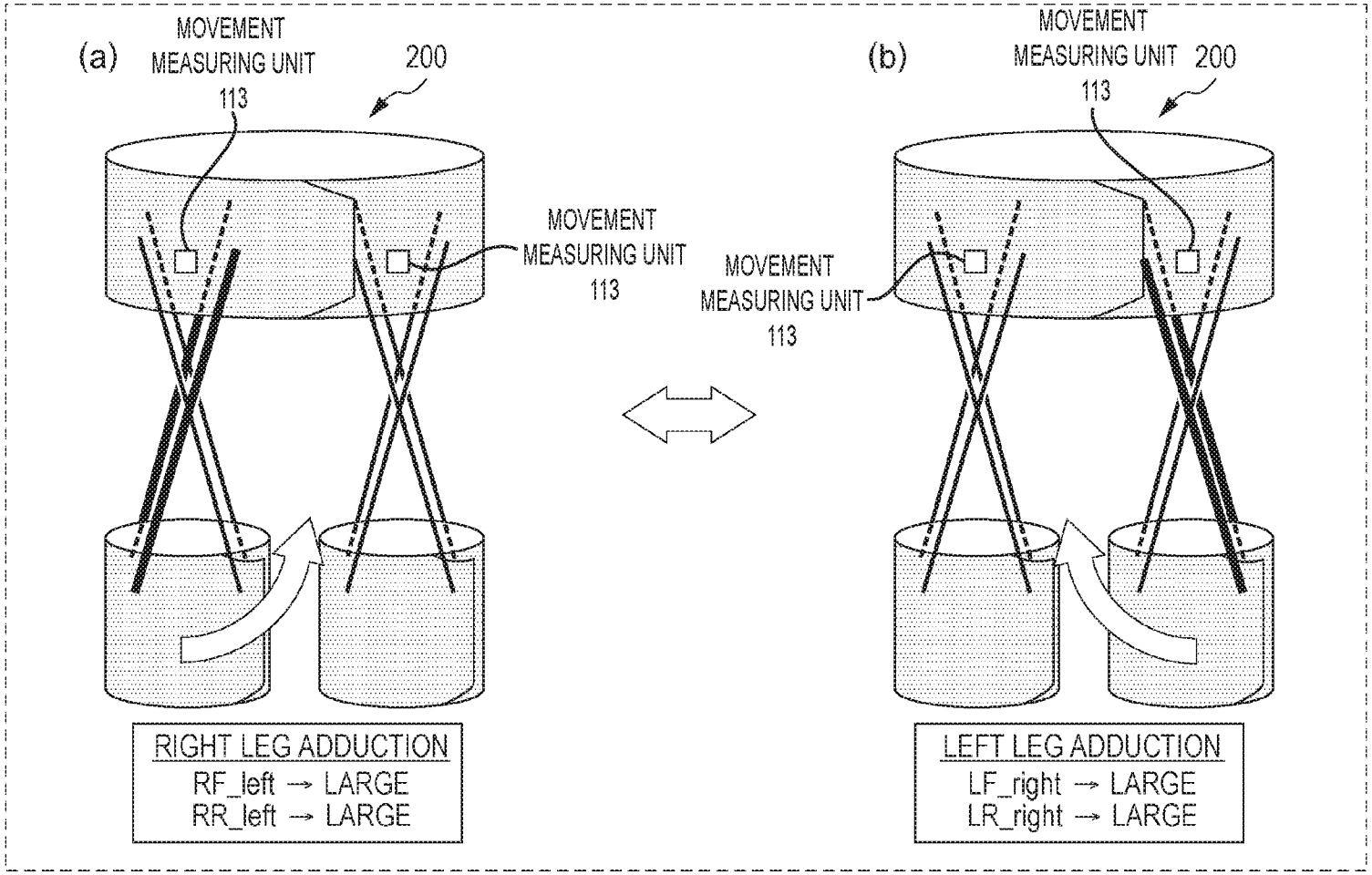
FIG. 10 illustrates assistance during adduction of the hip joint of the user.

FIG. 10 illustrates the case of assistance during adduction of the hip joint of the user.

As illustrated in FIG. 10(*a*), when assistance is provided during adduction of the hip joint of the right leg, the tension of each of the wires "RF_left" and "RR_left" is set to a value greater than or equal to the first threshold value. In addition, when assistance is provided during the adduction of the hip joint of the left leg, the tension of each of the wires "LF_right" and "LR_right" is set to a value greater than or equal to the first threshold value.

That is, the drive control unit 111 provides assistance during adduction or abduction of the leg of the user by performing any one of the following operations:

(a) Applying a tension greater than or equal to the first threshold value to each of the first wire and the fifth wire (b) Applying a tension greater than or equal to the first threshold value to the second wire and the sixth wire (c) Applying a tension greater than or equal to the first threshold value to the third wire and the seventh wire (d) Applying a tension greater than or equal to a first threshold value to the fourth wire and the eighth wire.

Figure 11:
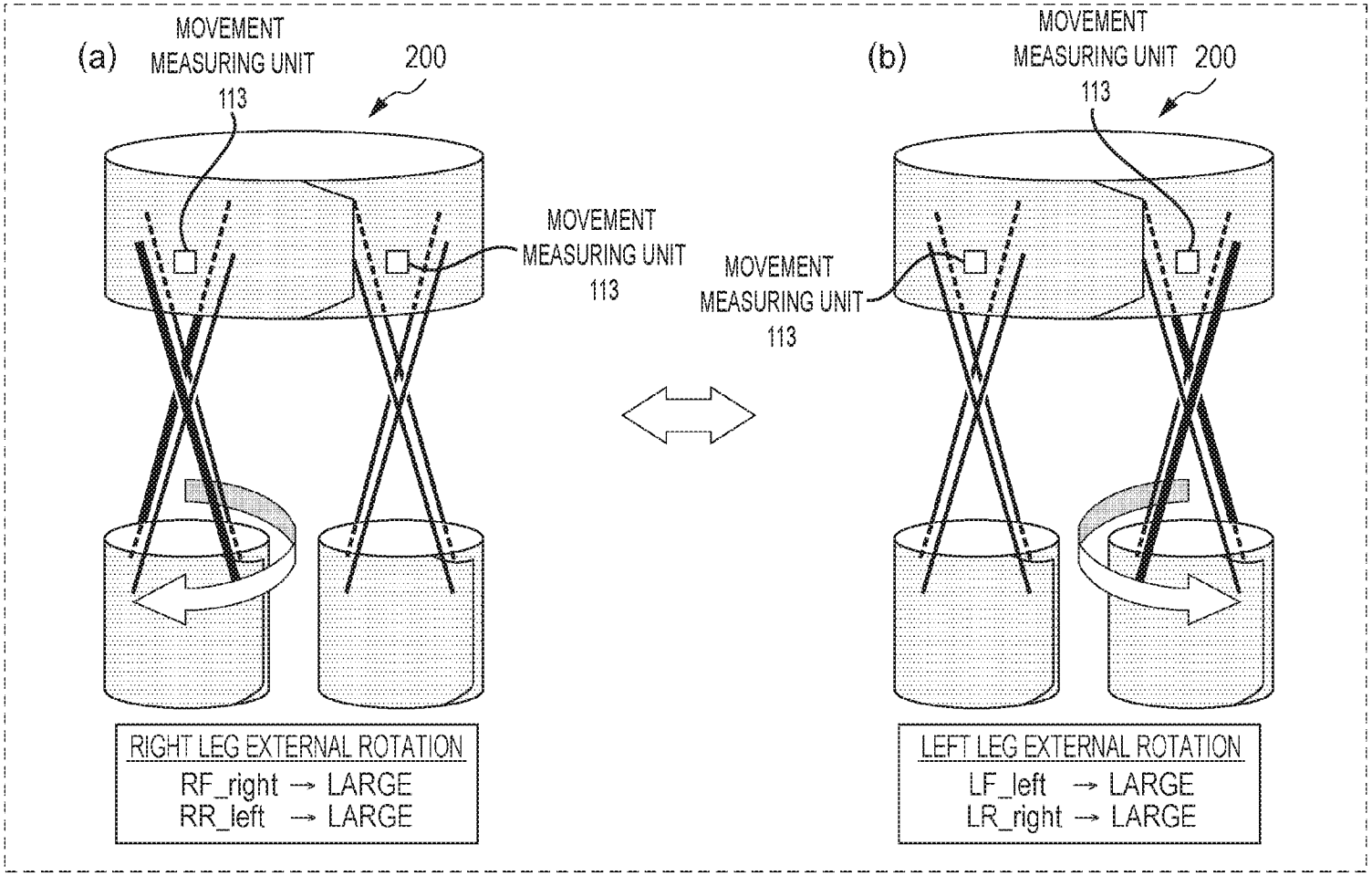
FIG. 11 illustrates assistance during external rotation of the hip joint of a user.
Figure 12:
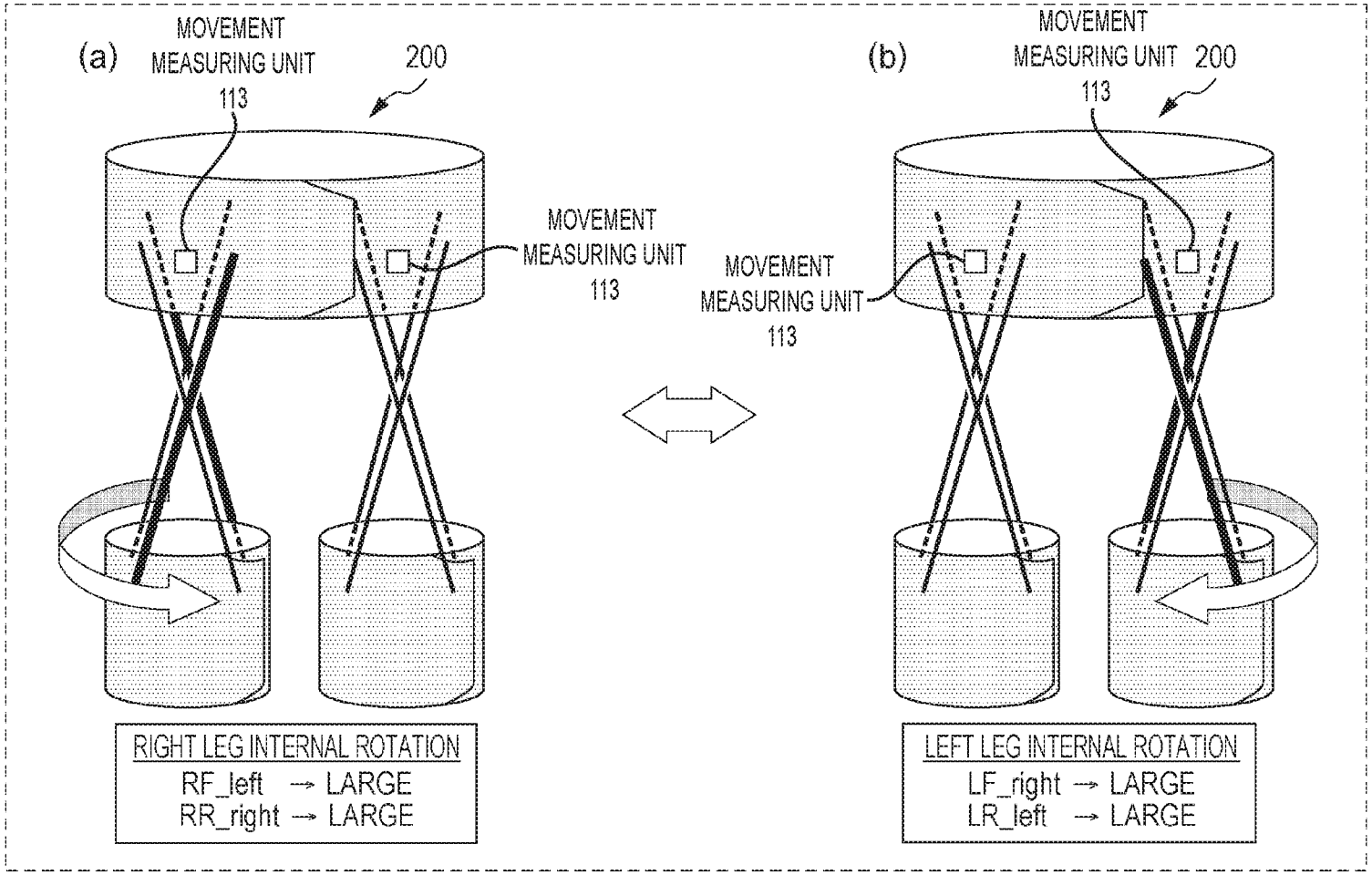
FIG. 12 illustrates assistance during internal rotation of the hip joint of a user.

FIG. 11 illustrates the case of assistance during external rotation of the hip joint of the user. FIG. 12 illustrates the case of assistance during internal rotation of the hip joint of the user.

When assistance is provided during external rotation of the hip joint of the right leg, the tension of each of the wires "RF_right" and "RR_left" is set to a value greater than or equal to the first threshold value. When assistance is provided during external rotation of the hip joint of the left leg, the tension of each of the wires "LF_left" and "LR_right" is set to a value greater than or equal to the first threshold value. In addition, when assistance is provided during the internal rotation of the hip joint of the right leg, the tension of each of the wires "RF_left" and "RR_right" is set to a value greater than or equal to the first threshold value. Furthermore, when assistance is provided during the internal rotation of the hip joint of the left leg, the tension of each of the wires "LF_right" and "LR_left" is set to a value greater than or equal to the first threshold value.

That is, the drive control unit 111 provides assistance during internal rotation or external rotation of the leg of the user by performing any one of the following operations:

(a) Applying a tension greater than or equal to the first threshold value to the first wire and the sixth wire (b) Applying a tension greater than or equal to the first threshold value to the second wire and the fifth wire (c) Applying a tension greater than the first threshold value to the third wire and the eighth wire (d) Applying a tension greater than or equal to the first threshold value to the fourth wire and the seventh wire.

Note that when assistance is provided during movement of the hip joint of the user in each of the directions, two particular wires are selected for each of the two legs and the tension of the selected wire is set to a value greater than or equal to the first tension (for example, 100 N). At this time, the tension of each of the other wires may be 0 N or a value less than or equal to a third threshold (for example, one tenth of the first threshold value). In addition, while the tension of each of the selected two wires has been set to the same value (100 N), the tensions of the two wires need not be the same. For example, when the tension of the wire on the front side is 100 N for assistance of abduction/adduction or internal rotation/external rotation, the tension of the wire on the rear side may be doubled to 200 N. As described above, since the moment arm of the hip joint on the front side differs from that on the rear side, the expected torque may not be output when the wires are pulled with the same tension. In addition, because there are individual differences, the balance between the tensions of the wires on the front side and the rear side may be adjusted according to individuals.

As described above, at the time of assistance, an assist force is mainly provided in the flexion direction and extension direction, and an assist force is provided in the abduction direction, the adduction direction, the external rotation direction, and internal rotation direction in accordance with the assist force to be applied in the stance phase or the swing phase. In this manner, the assist device can assist the user with walking more effectively.

Input of the calibration signal for measuring the slack of the upper-body belt unit 110 is described below. The calibration in the assist device 200 is conducted to detect slacking of the upper-body belt unit 110. The assist device 200 determines whether the upper-body belt unit 110 is slack by using the rotation of the upper-body belt unit 110.

Figure 13:
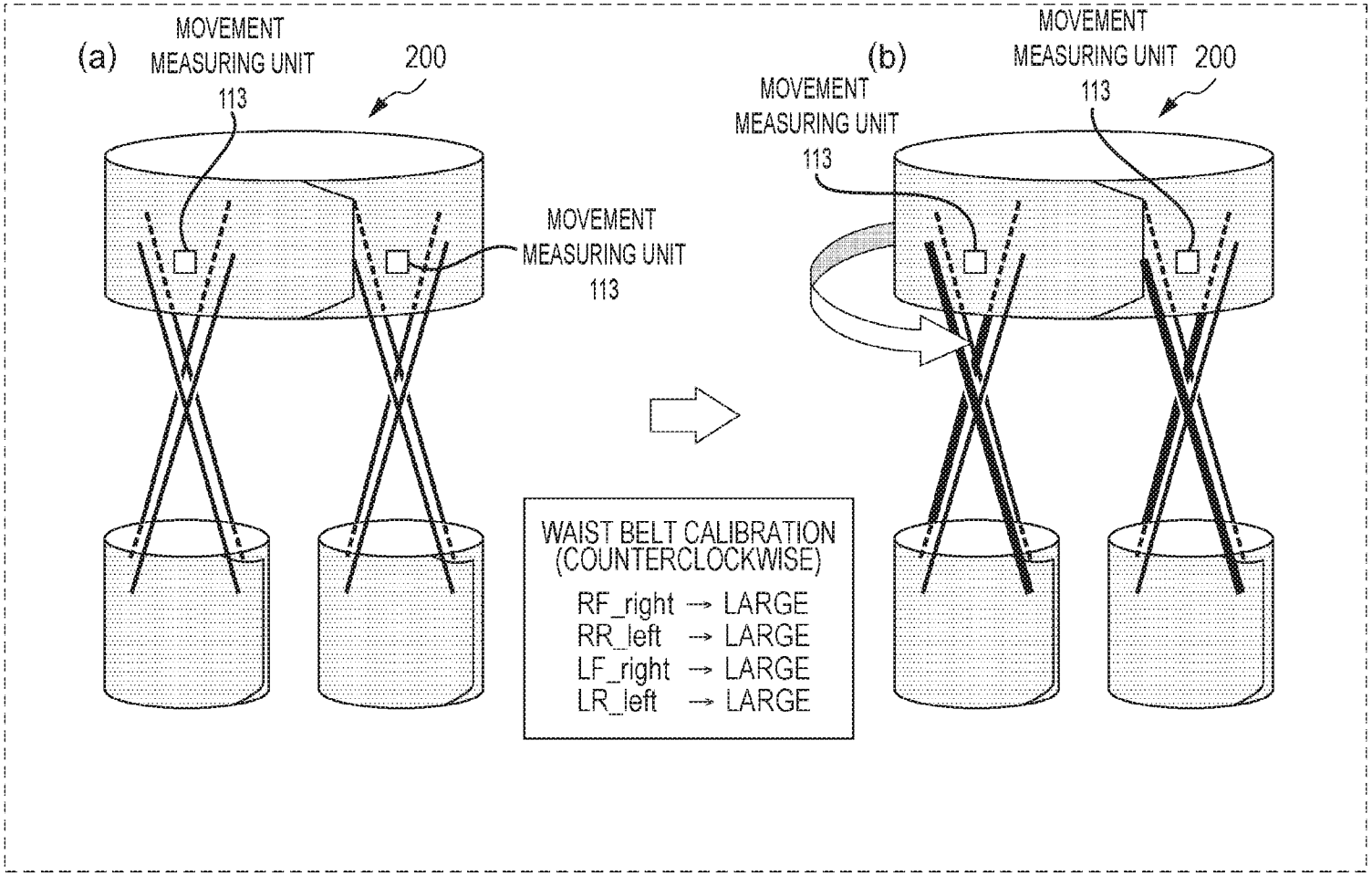
FIG. 13 illustrates an example of the movement of the upper-body belt unit that is slack at the time of inputting a calibration signal.

FIG. 13 illustrates an example of the movement of the upper-body belt unit that is slack at the time of inputting a calibration signal. In the case where the upper-body belt unit 110 is slack, the movement of the upper-body belt unit 110 in the vertical direction is stopped at the ilium of the user and, thus, the upper-body belt unit 110 is substantially stationary. Accordingly, if the wires 130 are pulled such that the upper-body belt unit 110 rotates in the rotation direction around the waist, the upper-body belt unit 110 moves in the rotation direction in which the upper-body belt unit 110 is pulled. Consequently, the movement of the upper-body belt unit 110 can be measured by using the acceleration sensor 114 and the gyro sensor 115.

FIG. 13(*a*) illustrates all of the wires each having a tension of 0 N. At this time, as illustrated in FIG. 13(*b*), a calibration signal is input to rotate the upper-body belt unit 110 that is slack in the counterclockwise direction (the left rotation direction). Then, the tension of each of the wires "RF_right", "RR_left", "LF_right", and "LR_left" is set to a value that is greater than or equal to the first threshold value (for example, 100 N). Thereafter, it is detected whether the upper-body belt unit 110 is slack by using the value measured by the movement measuring unit 113. At this time, the tension of the wire other than the wire having a tension set to the value greater than or equal to the first threshold value may be set to 0 N or a tension less than or equal to a third threshold value (for example, one tenth of the first threshold value).

Figure 14:
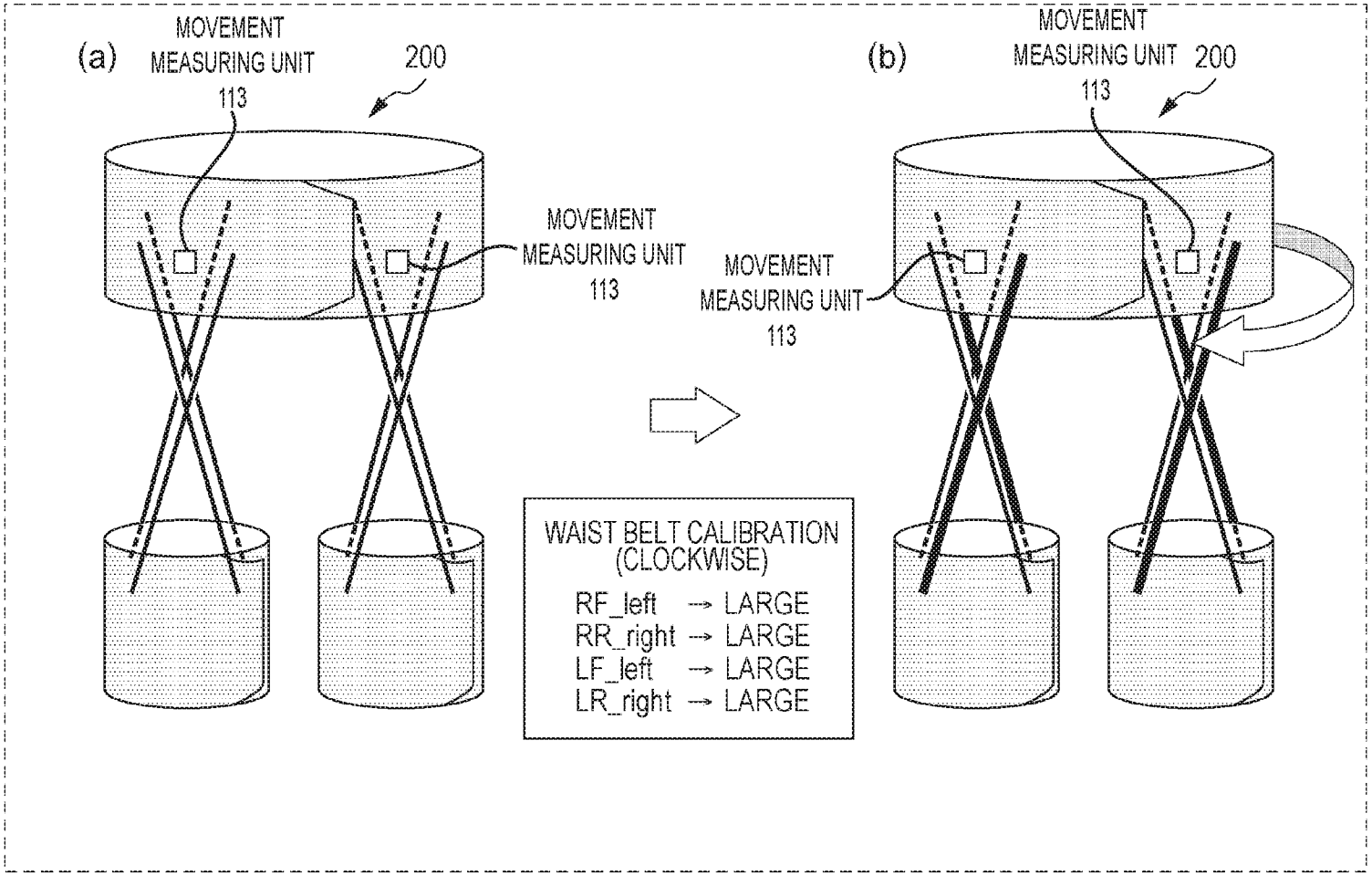
FIG. 14 illustrates another example of the movement of the upper-body belt unit that is slack at the time of inputting the calibration signal.

FIG. 14 illustrates another example of the movement of the upper-body belt unit that is slack at the time of inputting the calibration signal. FIG. 14 illustrates the case in which a calibration signal is input so that the wires are pulled to rotate the upper-body belt unit 110 clockwise (in the right rotation direction). At this time, the tension of each of the wires "RF_left", "RR_right", "LF_left", and "LR_right" is set to a value greater than or equal to the first threshold value (for example, 100 N). In this case, the tension of the wire other than the wire having a tension set to a value greater than or equal to the first threshold value may be set to 0 N or a value less than or equal to the third threshold value (for example, one tenth of the first threshold value).

As described above, unlike the case where assistance is provided, at the time of calibration, one of the wires connected to the right and left knee belt units 120 is selected, and a total of four wires are pulled at the same time. In this manner, the upper-body belt unit 110 is rotated, and slacking of the upper-body belt unit 110 is detected. That is, when detecting slacking of the upper-body belt unit 110, the drive control unit 111 controls the motor 112 to apply a tension greater than or equal to the first threshold to one of the first wire and the second wire and one of the third wire and the fourth wire at the same time. More specifically, when detecting slacking of the upper-body belt unit 110, the drive control unit 111 applies a tension greater than or equal to the first threshold value to the first wire and the third wire at the same time. Alternatively, when detecting slacking of the upper-body belt unit 110, the drive control unit 111 applies a tension greater than or equal to the first threshold value to the second wire and the fourth wire at the same time.

Note that the term "same time" used here means that two periods of time during which the tensions that are greater than or equal to the first threshold value are being applied overlap. That is, the condition that the tension greater than or equal to the first threshold value is applied to one of the first wire and the second wire and one of the third wire and the fourth wire at the same time is equivalent to the condition that the period of time during which a tension greater than or equal to the first threshold value is being applied to one of the first wire and the second wire overlaps the period of time during which a tension greater than or equal to the first threshold value is being applied to one of the third wire and the fourth wire overlap each other. That is, if the periods of time during which tensions each greater than or equal to the first threshold value are applied to different wires overlap, it can be said that the tensions are applied at the same time.

In addition, the drive control unit 111 applies a tension greater than or equal to the "first threshold value" to each of the wires by driving the motor 112. That is, if an extra tension is applied to the wire by the operation performed by the user and, thus, a tension greater than or equal to the "first threshold value" is applied to the wire, it is considered that the drive control unit 111 does not apply a tension greater than or equal to the first threshold to the wire.

Figure 15:
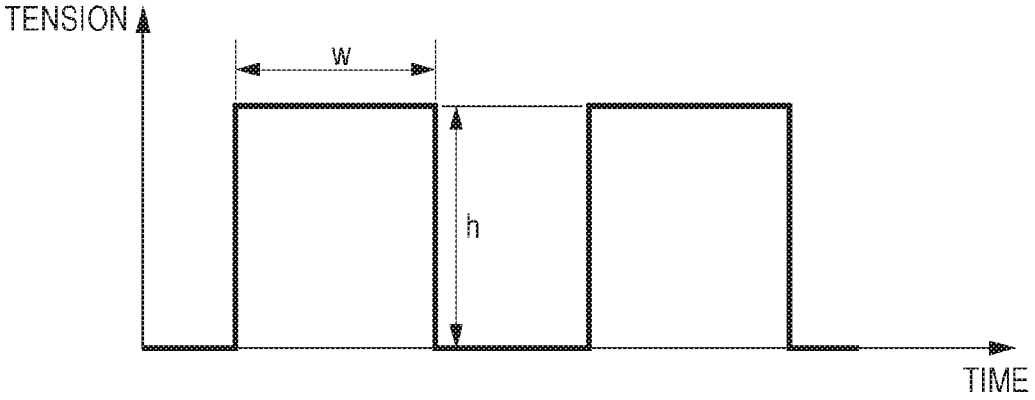
FIG. 15 is a graph illustrating the calibration signal when the input pattern is a pulse wave.
Figure 16:
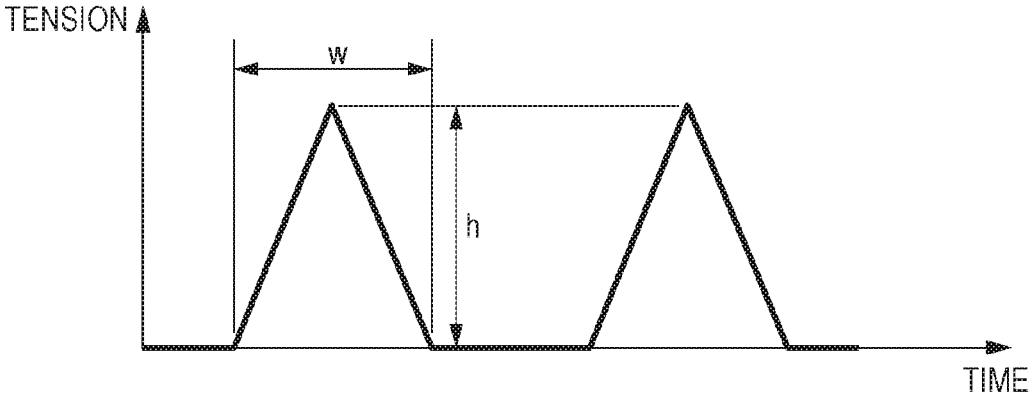
FIG. 16 is a graph illustrating the calibration signal when the input pattern is a triangular wave.

FIGS. 15 and 16 are graphs illustrating examples of a calibration signal. FIG. 15 is a graph illustrating a calibration signal when an input pattern is a pulse wave. FIG. 16 is a graph illustrating a calibration signal when the input pattern is a triangular wave. As illustrated in FIGS. 15 and 16, the input pattern of the calibration signal may be a pulse wave or a triangular wave.

In FIGS. 15 and 16, "w" represents the signal width, and "h" represents the input tension (the magnitude of a first tension).

The operation performed when a pulse wave is used as an input pattern of a calibration signal is described first. If the input tension h is too small, it is difficult to move the upper-body belt unit 110 sufficiently to accurately measure the slack of the upper-body belt unit 110 even when the upper-body belt unit 110 is slack. In contrast, if the input tension h is too large, it is likely to greatly move the upper-body belt unit 110 even when the upper-body belt unit 110 is fixed to the thigh of the user so as to sufficiently assist the user with movement of the two legs of the user. Accordingly, the magnitude of the input tension h may be determined so as to be within a predetermined range (for example, a range of 50 N to 400 N) that is applied when assisting the user with movement of the two legs of the user. When an input tension within the predetermined range is applied to the wire 130 and the upper-body belt unit 110 moves, the entire assist force is not transferred to the thigh of the user. Accordingly, in this case, the control unit 100 can determine that the upper-body belt unit 110 is slack and, thus, can determine that the user needs to tighten the upper-body belt unit 110 again.

In terms of the signal width w, the pulse wave is an input pattern in which the signal steeply rise and fall. Accordingly, if the signal width w is larger than a predetermined threshold value, for example, 0.1 seconds, the upper-body belt unit 110 can be moved so that slacking of the upper-body belt unit 110 can be accurately determined. However, to quickly detect slacking of the upper-body belt unit 110, the signal width w may be reduced so as not to be too large. Consequently, according to the present exemplary embodiment, when the input pattern of the calibration signal is a pulse wave, the signal width w can be set to a value in the range of, for example, 0.1 to 1.0 seconds.

Like the pulse wave, when the input signal is a triangular wave, the input tension h may be determined so as to be within a range that is substantially the same as the predetermined range that is applied when assistance is provided during movement of the two legs of the user (for example, a range of 50 N to 400 N). The influence of the signal width w on the upper-body belt unit 110 differs according to the value of the signal width w. For example, when the signal width w is as small as about 0.2 seconds, the time period from the time the input tension rises to h until the tension drops to the original value 0 is short. Accordingly, the signal pattern is close to a step input like a pulse wave, and the upper-body belt unit 110 operates in a similar manner to the operation for the pulse wave. In contrast, when the signal width w exceeds, for example, 1.0 second, the tension of the wire gradually linearly increases and decreases and, thus, the drive control unit 111 can control the motor 112 without any delay. That is, when the upper-body belt unit 110 is slack and if a calibration signal having the signal width w greater than 1.0 second is input to the drive control unit 111, the upper-body belt unit 110 is gradually pulled by the wire 130 since the rate of increase in the tension by the wire 130 is small. Thus, the upper-body belt unit 110 is gradually displaced from its original position. Subsequently, the input tension h decreases from the turning-back point, which corresponds to the apex of the triangular wave of the calibration signal. As a result, it is less likely for the upper-body belt unit 110 to return to the original position due to the reaction of the applied tension than in the case where a large tension is instantly applied to the upper-body belt unit 110.

That is, when the calibration signal having an input pattern of a triangular wave has a large signal width w (for example, 1.0 second or larger), the determination unit 102 of the control unit 100 calculates the amount of displacement of the upper-body belt unit 110 (the amounts of displacement in the X-axis direction, the Y-axis direction, and the Z-axis direction and the amounts of rotation about the X-axis, the Y-axis, and the Z-axis) from the acceleration and the angular velocity detected by the movement measuring unit 113 attached to the upper-body belt unit 110. In this manner, the determination unit 102 calculates the displacement of the upper-body belt unit 110 from its original position. If the calculated displacement exceeds a predetermined threshold value (for example, 1 cm), the determination unit 102 may determine that the upper-body belt unit 110 is slack.

While the present exemplary embodiment has been described with reference to usage of a determined single type of input pattern of the calibration signal to determine slacking of the upper-body belt unit 110, the processing is not limited thereto. For example, the above-described two types of input patterns of the calibration signal may be input, and slacking of the upper-body belt unit 110 may be detected by using a combination of measurement results from the movement measuring unit 113. For example, suppose that by inputting a calibration signal having an input pattern of a pulse wave to the drive control unit 111 four times, the movement of the upper-body belt unit 110 is examined. At this time, if it is determined that the upper-body belt unit 110 is slack twice, it is difficult to determine whether the upper-body belt unit 110 is actually slack. In such a case, the control unit 100 inputs a calibration signal having an input pattern of a triangular wave and having a large signal width w and obtains a value measured and returned by the movement measuring unit 113. If the return value of the amount of displacement of the upper-body belt unit 110 obtained when the calibration signal is input is greater than a predetermined threshold value (for example, 1 cm), it may be determined that the upper-body belt unit 110 is slack.

Figure 17:
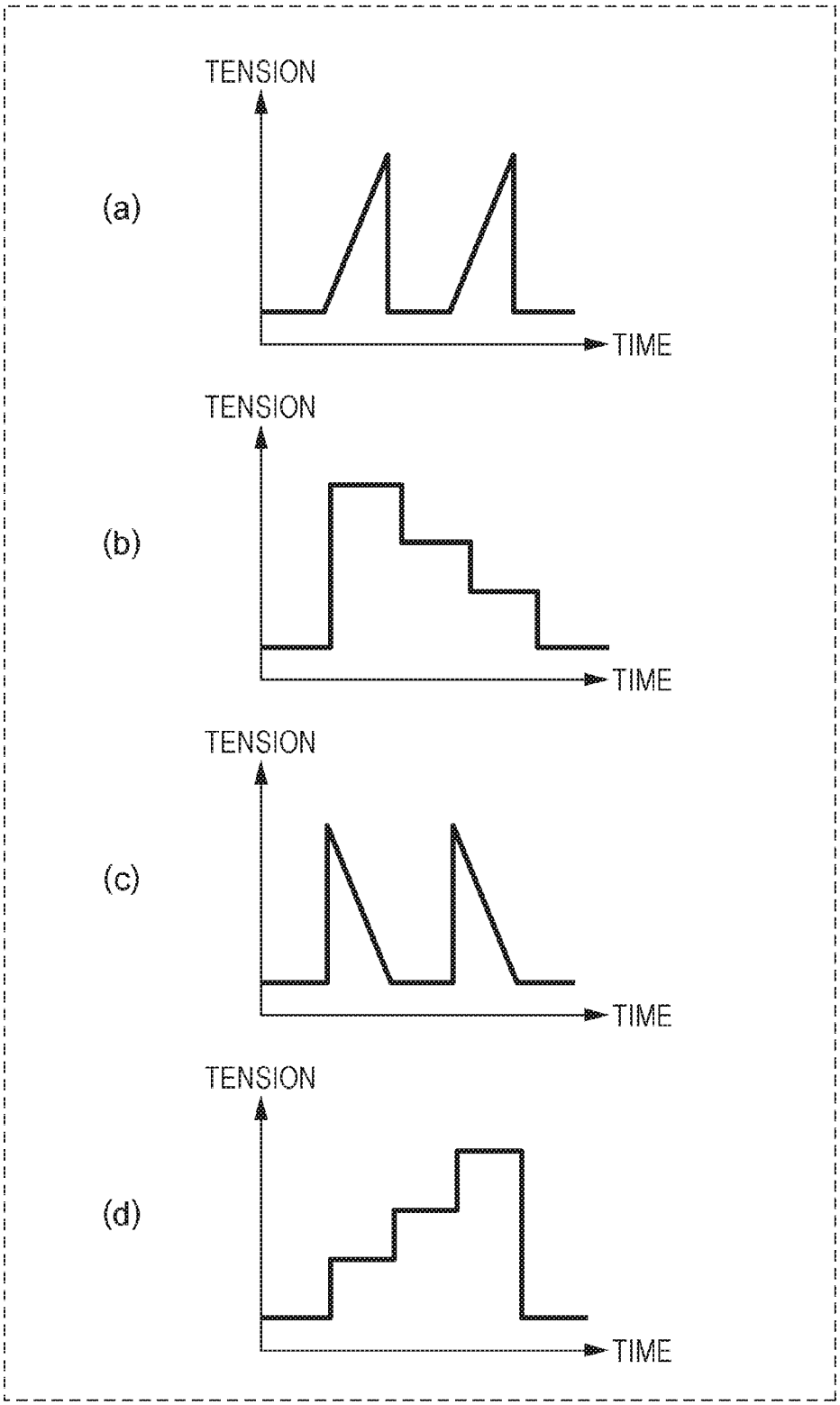
FIG. 17 illustrates calibration signals of the other input patterns.

In addition to the calibration signals of the input patterns illustrated in FIGS. 15 and 16, the calibration signals illustrated in FIGS. 17(*a*) to 17(*d*) may be used. More specifically, FIG. 17(*a*) is a graph illustrating a calibration signal of an input pattern in which the tension linearly increases and, thereafter, decreases stepwise. FIG. 17(*b*) is a graph illustrating a calibration signal of an input pattern in which the tension falls stepwise. FIG. 17(*c*) is a graph illustrating the calibration signal of the input pattern in which the tension increases stepwise and, thereafter, linearly decreases. FIG. 17 (*d*) is a graph illustrating a calibration signal of an input pattern in which the tension increases stepwise. In this way, by inputting any one of the calibration signals of the input patterns illustrated in FIGS. 17(*a*) to 17(*d*), the movement of the upper-body belt unit 110 in accordance with a change in each of the tensions may be observed. In this manner, slacking of the upper-body belt unit 110 may be detected.

For example, in the case of using the calibration signal illustrated in FIG. 17(*a*), since the tension of the upper-body belt unit 110 decreases stepwise, the upper-body belt unit 110 begins to return to its original position violently and eventually past the original position. In addition, in the case of using the calibration signals illustrated in FIGS. 17(*b*) and 17(*c*), the same result as when "w" of the triangular wave in FIG. 16 is large is obtained. Furthermore, in the case of using the calibration signal illustrated in FIG. 17(*d*), the displacement of the upper-body belt unit 110 gradually increases and, thus, the displacement of the upper-body belt unit 110 from its original position is eventually large. In this way, by detecting slacking of the upper-body belt unit 110 by using the calibration signals of a plurality of types of input patterns, the accuracy of detection of slacking of the upper-body belt unit 110 can be improved.

1-1-2. Drive Control Unit

The drive control unit 111 is provided in the upper-body belt unit 110. The drive control unit 111 drives the motor 112 in accordance with a signal received from the signal input unit 101. More specifically, the drive control unit 111 calculates the necessary rotational speed of the motor 112 from the input tension indicated by the signal received from the signal input unit. Thereafter, the drive control unit 111 rotates the motor 112 at the calculated rotational speed required. If the signal received from the signal input unit 101 indicates the required rotational speed of the motor 112, the drive control unit 111 may rotate the motor 112 at the required rotational speed indicated by the signal.

1-1-3. Movement Measuring Unit

The movement measuring unit 113 is provided in the upper-body belt unit 110. The movement measuring unit 113 measures the movement of the upper-body belt unit 110 and transmits time-series data that is the measurement result of the measured movement to the determination unit 102. More specifically, the movement measuring unit 113 includes the acceleration sensor 114 and the gyro sensor 115. The movement measuring unit 113 measures the movement of the upper-body belt unit 110 when the upper-body belt unit 110 is pulled by the motor 112 via the wires 130. In particular, if the upper-body belt unit 110 is not sufficiently tightly attached to the thigh, the displacement caused by the movement when the upper-body belt unit 110 is pulled by the wires 130 increases, as compared with in the case where the upper-body belt unit 110 is sufficiently tightly attached to the thigh. In addition, when the attachment position of the upper-body belt unit 110 is displaced from a predetermined position, a force is applied to the upper-body belt unit 110 in the rotation direction when the upper-body belt unit 110 is pulled by the wire 130, for example. How to select one of the values acquired by the movement measuring unit 113 to determine the fit of the upper-body belt unit 110 is described in more detail below.

According to the present exemplary embodiment, it is assumed that the knee belt units 120 are attached to the user's knees without slack in order to detect slacking of the upper-body belt unit 110. However, the configuration is not limited thereto. For example, when the upper-body belt unit 110 and the knee belt units 120 are attached with slack, a movement measuring unit having the same configuration as that of the movement measuring unit 113 may be provided in each of the knee belt units 120, and slacking of each of the knee belt units 120 may be further detected. At this case, it is difficult to detect slacking of the upper-body belt unit 110 and slacking of the knee belt unit 120 at the same time. Accordingly, for example, slacking of each of the knee belt units 120 may be detected first. After tightly attaching the knee belt units 120 to the user, a calibration signal may be input again to detect slacking of the upper-body belt unit 110.

The movement of the knee belt units 120 in the vertical direction is likely to occur. Accordingly, unlike the detection of slacking of the upper-body belt unit 110, slacking may be detected by using, for example, the condition that the tension of each of the wires "RF_right", "RF_left", "LF_right", and "LF_left" is greater than or equal to the first threshold (100 N). Conversely, slacking may be detected by using the condition that the tension of each of only the wires on the rear side, that is, the wires "RR_right", "RR_left", "LR_right", "LR_left" is greater than or equal to the first threshold (100 N).

Thereafter, slacking of the upper-body belt unit 110 may be detected by using the above-described method. As described above, by detecting slacking of the knee belt unit 120 first and, subsequently, detecting slacking of the upper-body belt unit 110, the user can wear the assist device 200 on the body more reliably and, thus, can be assisted more effectively.

Basically, the assist device 200 is used to assist the user with motion, such as, walking. To properly assist the user, the assist device 200 needs to determine whether the upper-body belt unit 110 is slack immediately after the assist device 200 is attached to the user or after the assist device 200 is operated for a while. That is, the assist device 200 needs to make the determination when the movement of the user stops. Accordingly, the movement measuring unit 113 determines from the values measured by the acceleration sensor 114 and the gyro sensor 115 whether the movement of the user stops and transmits, to the signal input unit 101, a start signal indicating that calibration is to be started.

Figure 18:
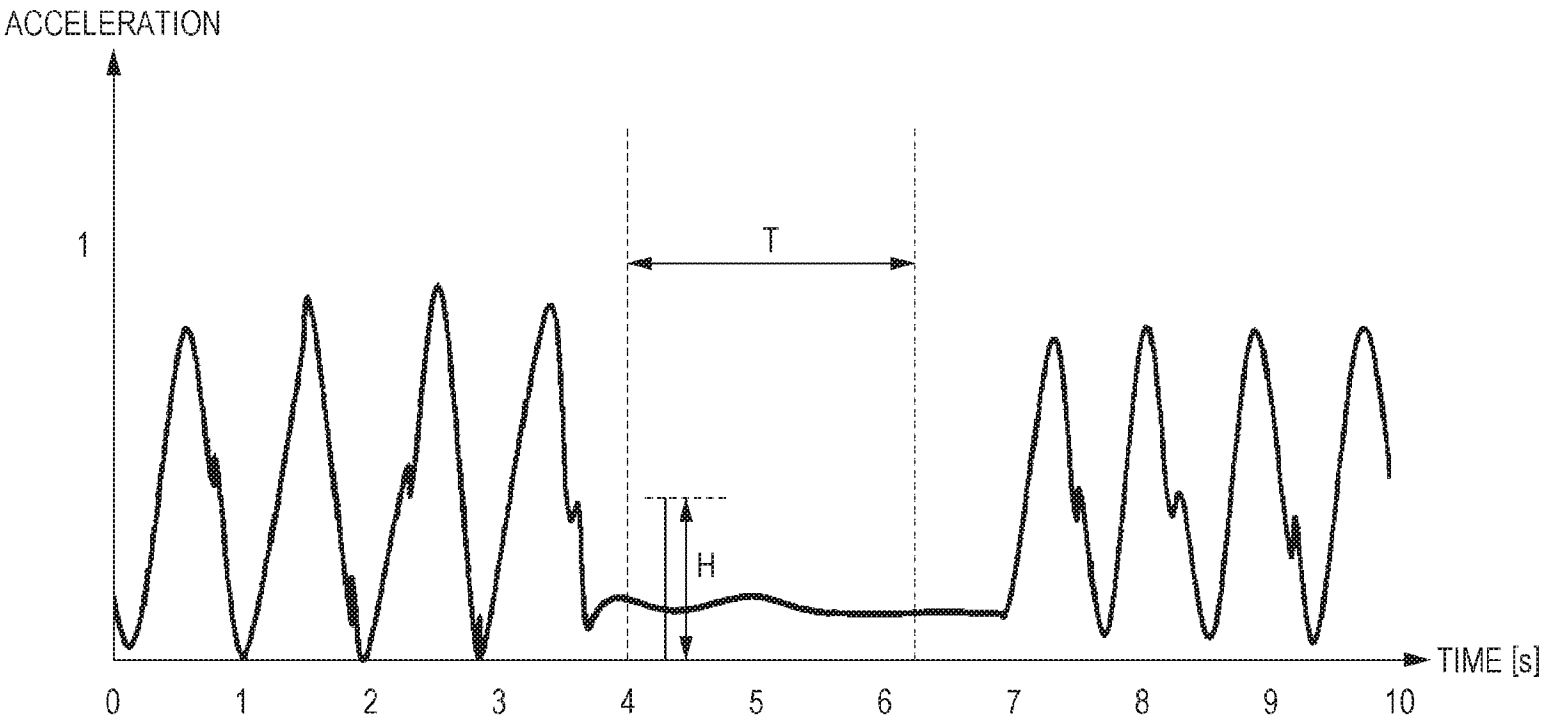
FIG. 18 illustrates an example of a process for determining the point in time at which calibration is started.

FIG. 18 illustrates an example of the process of determining the point in time at which the calibration is started. In the graph illustrated in FIG. 18, the abscissa represents the time, and the ordinate represents the acceleration obtained by combining the acceleration components in the X-axis direction, the Y-axis direction, and the Z-axis direction. In addition, FIG. 18 illustrates an example of a change in acceleration obtained by combining the acceleration components in the X-axis direction, the Y-axis direction, and the Z-axis direction acquired by the movement measuring unit 113 when the user who is walking stops, for example, in front of a traffic signal. As illustrated in FIG. 18, if, during a predetermined period of time T (for example, 2 seconds or longer), a change in the acceleration obtained by combining the acceleration components in the X-axis direction, the Y-axis direction, and the Z-axis direction is smaller than or equal to a second threshold value H (for example, 0.3 $m/s^2$), the movement measuring unit 113 may determine that the movement of the user stops and transmits, to the signal input unit 101, the start signal. That is, the movement measuring unit 113 further determines whether the acceleration obtained by combining the acceleration components in the X-axis direction, the Y-axis direction, and the Z-axis direction measured by the acceleration sensor 114 included in the upper-body belt unit 110 is less than or equal to a second threshold value. In this manner, the movement measuring unit 113 determines whether the point in time to start calibration is reached. Thereafter, if the acceleration obtained by combining the acceleration components in the X-axis direction, the Y-axis direction, and the Z-axis direction is smaller than or equal to the second threshold value, the movement measuring unit 113 transmits, to the signal input unit 101, a start signal indicating that calibration is to be started.

In the above-described example, to determine the start of calibration, the predetermined period of time T is set to 2 seconds, and the second threshold value H of a change in the acceleration obtained by combining the acceleration components in the X-axis direction, the Y-axis direction, and the Z-axis direction is set to 0.3 $m/s^2$. However, the values are not limited thereto. Since it is only required to distinguish a user that is moving, such as walking, from a user that is stationary, the human walking cycle may be measured by the acceleration sensor 114. Thereafter, the predetermined period of time T may be set to twice the walking period. For example, when the walking cycle of the user is 1.5 seconds, the predetermined period of time T may be set to 3 seconds. In addition, the second threshold value H of a change in the acceleration obtained by combining the acceleration components in the X-axis direction, the Y-axis direction, and the Z-axis direction may be determined on the basis of a change in the acceleration obtained by combining the acceleration components of the walking motion of the user in the X-axis direction, the Y-axis direction, and the Z-axis direction. For example, the second threshold value H may be set to one-third of the change in acceleration obtained by combining the acceleration components in the X-axis direction, the Y-axis direction, and the Z-axis direction of the walking motion of the user.

As described above, if the change in acceleration obtained by combining the acceleration components in the X-axis direction, the Y-axis direction, and the Z-axis direction during the predetermined period of time T is less than or equal to the second threshold value H, the movement measuring unit 113 determines that calibration is to be started. However, the time of starting calibration is not limited thereto. For example, a start button for starting the calibration may be provided on the assist device 200, and the user may press the start button to start the calibration. For example, the start button may be provided on the control unit 100 or the upper-body belt unit 110, and the user may press the button by themselves to detect slacking of the knee belt when, for example, waiting for a traffic light. To make the above-described determination, the movement measuring unit 113 is configured to include the acceleration sensor 114 and the gyro sensor 115 and a dedicated circuit and a processor that make the determination. If the above determination is not needed, the movement measuring unit 113 is configured to include the acceleration sensor 114 and the gyro sensor 115 without including a dedicated circuit and a processor.

1-1-4. Determination Unit

The determination unit 102 is a unit that determines from the measurement result transmitted from the movement measuring unit 113 whether the upper-body belt unit 110 attached to the user is slack. In addition, the determination unit 102 is a unit that detects the displacement of the attachment position of the upper-body belt unit 110 attached to the user. More specifically, the determination unit 102 receives a calibration start signal from the signal input unit 101 and enters a determination mode for detecting slacking of the upper-body belt unit 110. After entering the determination mode, the determination unit 102 receives the values of the acceleration and the angular velocity from the movement measuring unit 113 and determines whether the upper-body belt unit 110 is slack.

A method for detecting slacking of the upper-body belt unit 110 by using the determination unit 102 is described below.

When the upper-body belt unit 110 that is slack pulls the knee belt unit 120, sliding of the upper-body belt unit 110 in the vertical direction is prevented by the ilium of the user. Accordingly, even when the upper-body belt unit 110 is slack (not firmly attached), the upper-body belt unit 110 is less likely to move in the vertical direction. In contrast, if a force is applied to the upper-body belt unit 110 that is slack in the rotation direction around the waist, the upper-body belt unit 110 rotates and is displaced.

As illustrated in FIG. 19, the vertical direction of the user is defined as the X-axis direction, the right-left direction of the user is defined as the Y-axis direction, and the front-rear direction of the user is defined as the Z-axis direction. The upward X-axis direction is a positive direction. The left Y-axis direction as viewed from the user is a positive direction, and the frontward Z-axis direction of the user is a positive direction.

Figure 20:
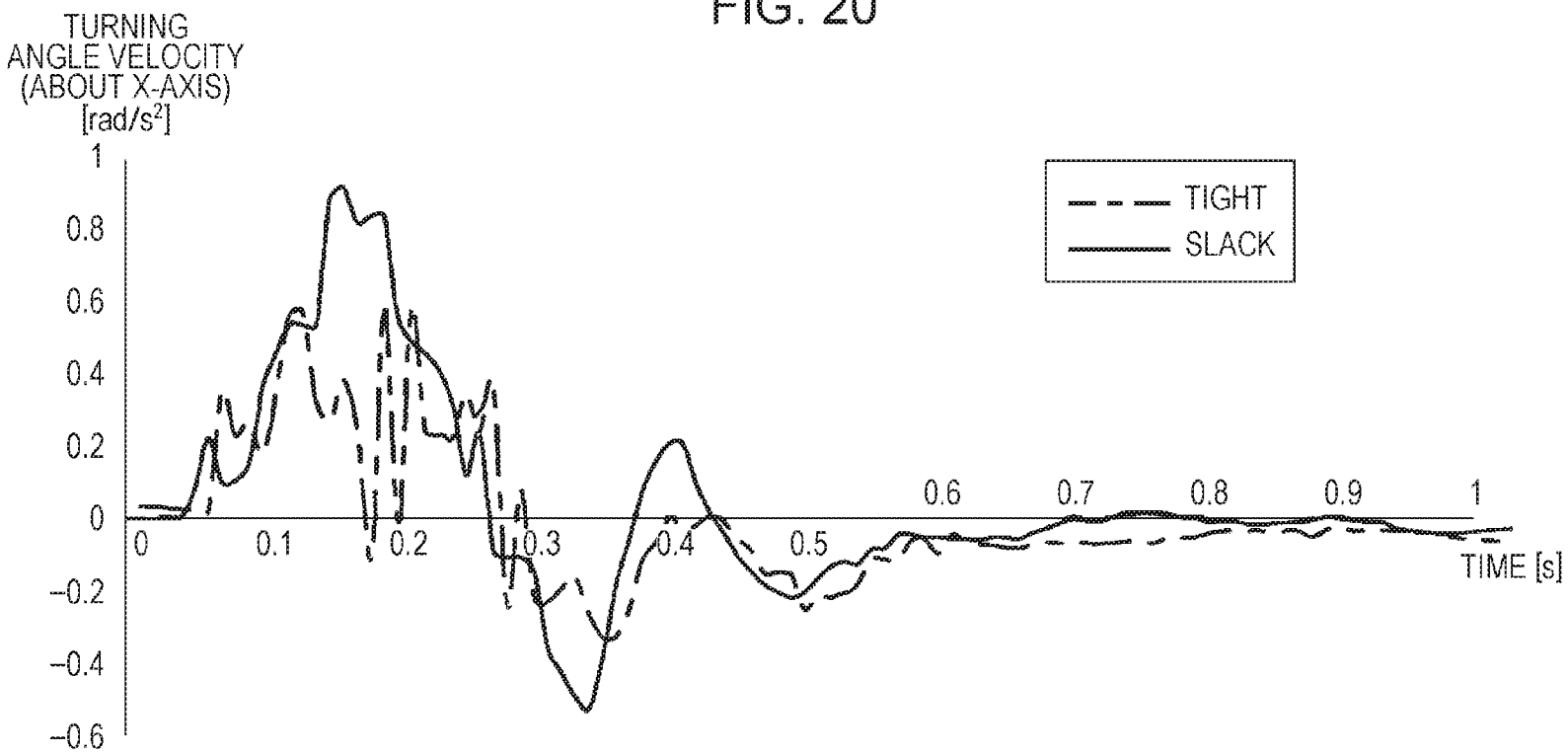
FIG. 20 is a graph illustrating a change in the angular velocity of the upper-body belt unit about the X-axis when a tension greater than or equal to a first threshold value is applied to four of the eight wires by inputting a calibration signal in the form of a pulse wave.

In the assist device 200, since the wires 130 are disposed in substantially the X-Y plane so that every two wires cross each other obliquely in the X-Y plane. Accordingly, when the knee belt unit 120 that is slack is pulled, the component of the tension in the Y-axis direction of each of the wires acts on the upper-body belt unit 110. Thus, the acceleration in the Y-axis direction of the upper-body belt unit 110 varies. In addition, since the upper-body belt unit 110 rotates about the X-axis, the angular velocity about the X-axis varies most among the angular velocities about the three axes. FIG. 20 illustrates an example of the angular velocity about the X-axis.

FIG. 20 is a graph illustrating a variation of the angular velocity of the upper-body belt unit 110 about the X-axis that occurs when a tension greater than or equal to the first threshold value is applied to each of four of the eight wires 130 by inputting a pulse-wave calibration signal of w=0.2 seconds and h=100 N to the drive control unit 111. In the graph illustrated in FIG. 20, the abscissa represents the time, and the ordinate represents the angular velocity about the X-axis. Note that in the data illustrated in FIG. 20, the tension of each of the four wires "RF_right", "RR_left", "LF_right", and "LR_left" is set to the first threshold value (100 N). In addition, the alternate long and short dash line (TIGHT) in the graph indicates a variation of the angular velocity when the upper-body belt unit 110 is fastened tightly, and the solid line (SLACK) indicates a variation of the angular velocity when the upper-body belt unit 110 is slack. As can be seen from FIG. 19, the variation of the angular velocity about the X-axis is larger when the upper-body belt unit 110 is slack than when the upper-body belt unit 110 is fastened tightly. Accordingly, the determination unit 102 determines that the attachment position of the upper-body belt unit 110 is displaced if the variation of the angular velocity about the X-axis is greater than or equal to a predetermined threshold value (for example, 0.8 rad/$s^2$) for a pulse-wave calibration signal for which the first tension (for example, h=100 N) is set. Thus, the determination unit 102 determines that the upper-body belt unit 110 is slack.

As described above, the determination unit 102 detects the angular velocity about the X-axis and determines whether the upper-body belt unit 110 is slack. However, a determination method is not limited thereto. For example, if each of the change in acceleration in the Y-axis direction and the change in angular velocity about the X-axis is greater than or equal to a corresponding predetermined threshold value, the determination unit 102 may determine that the attachment position of the upper-body belt unit 110 is displaced and, thus, determine that the upper-body belt unit 110 is slack. Furthermore, instead of pulling the four wires at the same time, only two wires (for example, the wires "LF_right" and "LR_left") may be pulled at the same time, or only one wire (for example, the wire "LF_right") may be pulled. Then, the change in angular velocity about the Z-axis may be measured. Thereafter, by using the change in angular velocity, the determination unit 102 may determine whether the attachment position of the upper-body belt unit 110 is displaced and, thus, whether the upper-body belt unit 110 is slack. When only two wires disposed next to each other in the horizontal direction or only one wire is pulled, rotation about the Z-axis occurs more easily than when the four wires (front right, front left, rear right, and rear left wires) for each of the legs are pulled at the same time, since the balance between the tensions applied to the upper-body belt unit 110 in the X-Y plane is not maintained. Alternatively, if any one of the change in acceleration in the Y-axis direction, the change in angular velocity about the X-axis, and the change in angular velocity about the Z-axis is greater than or equal to a corresponding predetermined threshold value, the determination unit 102 may determine that the attachment position of the upper-body belt unit 110 is displaced and, thus, the upper-body belt unit 110 is slack. As a result, the determination unit 102 can have the robustness of slack detection and can determine whether the upper-body belt unit 110 is slack more accurately.

When a tension of 100 N is applied to the wire and if any one of the change in acceleration in the Y-axis direction, the change in angular velocity about the X-axis, and the change in angular velocity about the Z-axis is greater than or equal to the corresponding predetermined threshold value, the determination unit 102 may determine that the attachment position of the upper-body belt unit 110 is displaced and, thus, the upper-body belt unit 110 is slack. Note that a method for detecting slacking is not limited thereto. For example, in the case where a tension, which is an input signal, in the range of 50 N to 400 N is applied to the wire, if the change in acceleration in the Y-axis direction is 1.0 $m \cdot s^2$ or greater or if the change in angular velocity about the X-axis is 0.6 rad/$s^2$ or greater or if the change in angular velocity is 0.3 rad/$s^2$ or greater, the determination unit 102 may determine that the attachment position of the upper-body belt unit 110 is displaced and, thus, the upper-body belt unit 110 is slack.

In addition, at least one of a pair consisting of the value of the first tension of the calibration signal and the predetermined threshold value of the change in acceleration in the Y-axis direction, a pair consisting of the value of the first tension of the calibration signal and the predetermined threshold value of the change in angular velocity about the X-axis, and a pair consisting of the value of the first tension of the calibration signal and the predetermined threshold value of the change in angular velocity about the Z-axis may be set according to the user. Thereafter, the determination unit 102 may determine whether the attachment position of the upper-body belt unit 110 is displaced, that is, the upper-body belt unit 110 is slack. The value of the first tension may differ according to users. In this case, the assist device 200 may include a reception unit that receives the preference from the user. The reception unit is implemented by, for example, an input interface (IF), such as a button, a switch, an input key, or a touch panel, a processor, and a memory.

For example, the tightness and/or the fit of the upper-body belt unit 110 differ according to individual. Accordingly, when using the assist device 200 for the first time and/or at predetermined intervals after the user starts to use the assist device 200, the user may tighten the upper-body belt unit 110 by themselves and store the value of the change in acceleration and the value of the change in angular velocity of the upper-body belt unit 110. Thereafter, by using the stored values, the user may set the predetermined threshold values used in the above-described determination as to whether the upper-body belt unit 110 is slack. That is, for a user who prefers a tight upper-body belt unit 110, the predetermined threshold value may be set to a value that is less than an initially set value (a standard value) by, for example, about 5 to 20%. For a user who prefers a loose upper-body belt unit 110, the predetermined threshold value may be set to a value that is greater than the standard value by about 5 to 20%. That is, the assist device may further include a reception unit that receives a value set by the user and a storage unit that stores the set value received by the reception unit. In addition, the control unit may adjust the first threshold value in accordance with the set value stored in the storage unit and output, as the information, the result of determination made by using the adjusted first threshold value.

As described above, even when the users have their own preferences or the same user feels different tightness due to, for example, their clothing on the day of use of the assist device 200, the slack of the upper-body belt unit 110 can be appropriately determined by setting the predetermined threshold value used to determine the slack of the upper-body belt unit 110 to a different value in accordance with the above-described different preference or tightness.

As described above, according to the present exemplary embodiment, basically, by applying the first tension to each of four particular wires disposed in front right, front left, rear right, and rear left positions, slacking of the upper-body belt unit 110 can be detected. At this time, by mainly measuring the change in the angular velocity of rotation of the upper-body belt unit 110 around the waist caused by the tensions of the wires, the slack of the upper-body belt unit 110 can be determined noticeably. The connection points of the wires 130 and a technique for fixing the wires 130 are described below. The connection points and the fixing technique of the wires 130 are effective to noticeably measure the velocity component in the rotational direction around the vertical axis of the user and the angular velocity component in the rotation direction around the axis of the user extending in the front-rear direction.

The movement measuring unit 113 that calculates the rotational component about the X-axis and the connection points of the wires 130 are described first.

Figure 21:
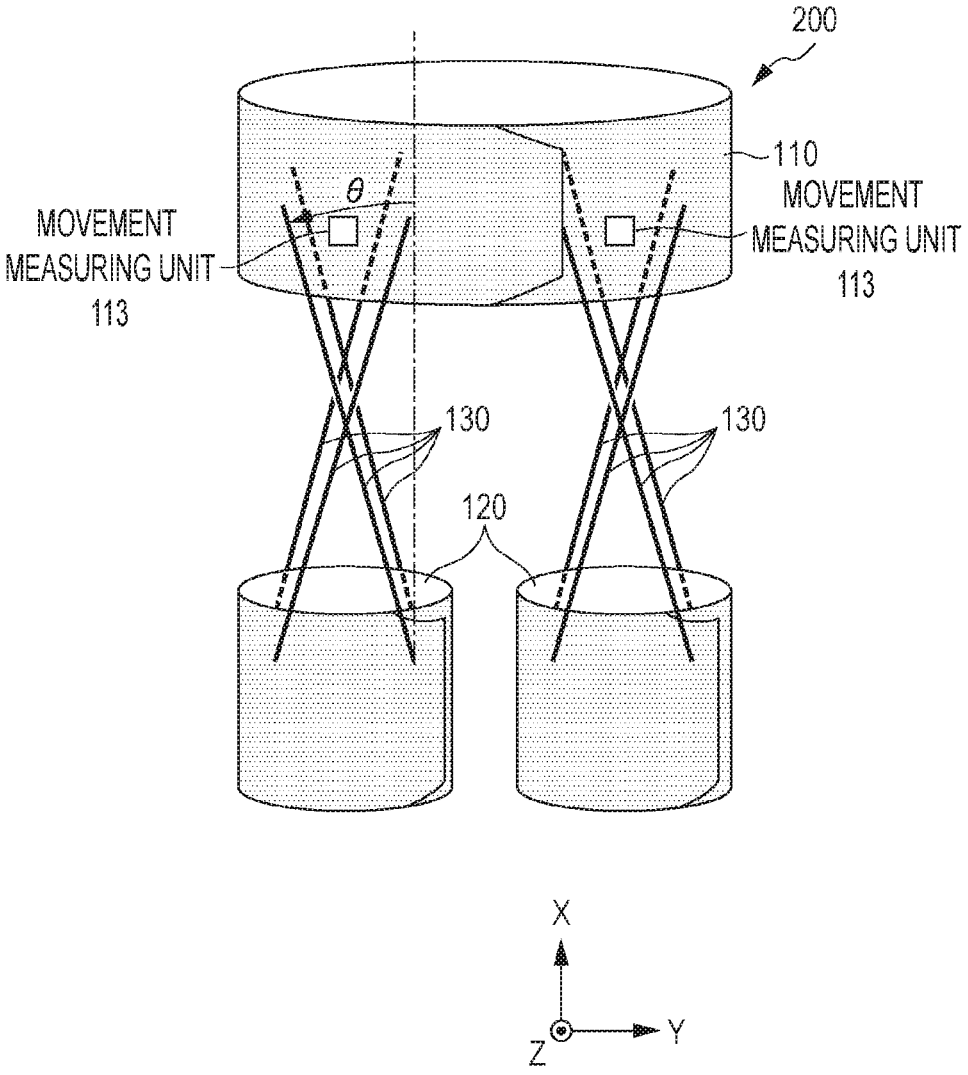
FIG. 21 illustrates an example of connection points at which the wires are connected to a movement measuring unit.

FIG. 21 illustrates an example of the connection points at which the wires 130 are connected to the movement measuring unit 113.

When pulling four wires consisting of the front right, front left, rear right, and rear left wires, a component of the tension in the Y-axis direction needs to be generated from each of the wires and, thus, the wires that cross each other needs to be inclined from the vertical direction. FIG. 21 illustrates an example of the upper-body belt unit 110 rotated in a counterclockwise direction. In this case, for example, the wire "RF_right" can have a predetermined angle θ (for example, θ is greater than or equal to 10 degrees and less than 45 degrees) with respect to the X-axis. If the predetermined angle θ is too small, it is difficult to rotate the upper-body belt unit 110 during calibration, as described above. In contrast, if the predetermined angle θ is too large, control at the time of assistance and, in particular, control at the time of assistance in the flexion and extension directions is difficult. Accordingly, the wires may be arranged such that the attachment angle of the wires arranged to cross each other meets the condition of the upper limit and the lower limit of the predetermined angle θ defined as described above.

While the attachment angle of the wire is set to the predetermined angle θ (an angle greater than or equal to 10 degrees and less than 45 degrees), the attachment angle is not limited thereto. When a different user wears the assist device 200, the attachment angle of the wire varies according to the circumference of the waist and the circumference of the knee of the user. Accordingly, for example, the assist device 200 may be configured such that the attachment position of the wire can be adjusted each time the user wears the assist device 200, the attachment position of the wire can be changed, and the angle can be made the same according to the user. Alternatively, the attachment position of the wire may be determined by, for example, assisting the user with flexion and extension after adjusting the angle and determining whether the user is assisted and by inputting a calibration signal when the upper-body belt unit 110 is slack and determining whether the upper-body belt unit 110 rotates.

Figure 22:
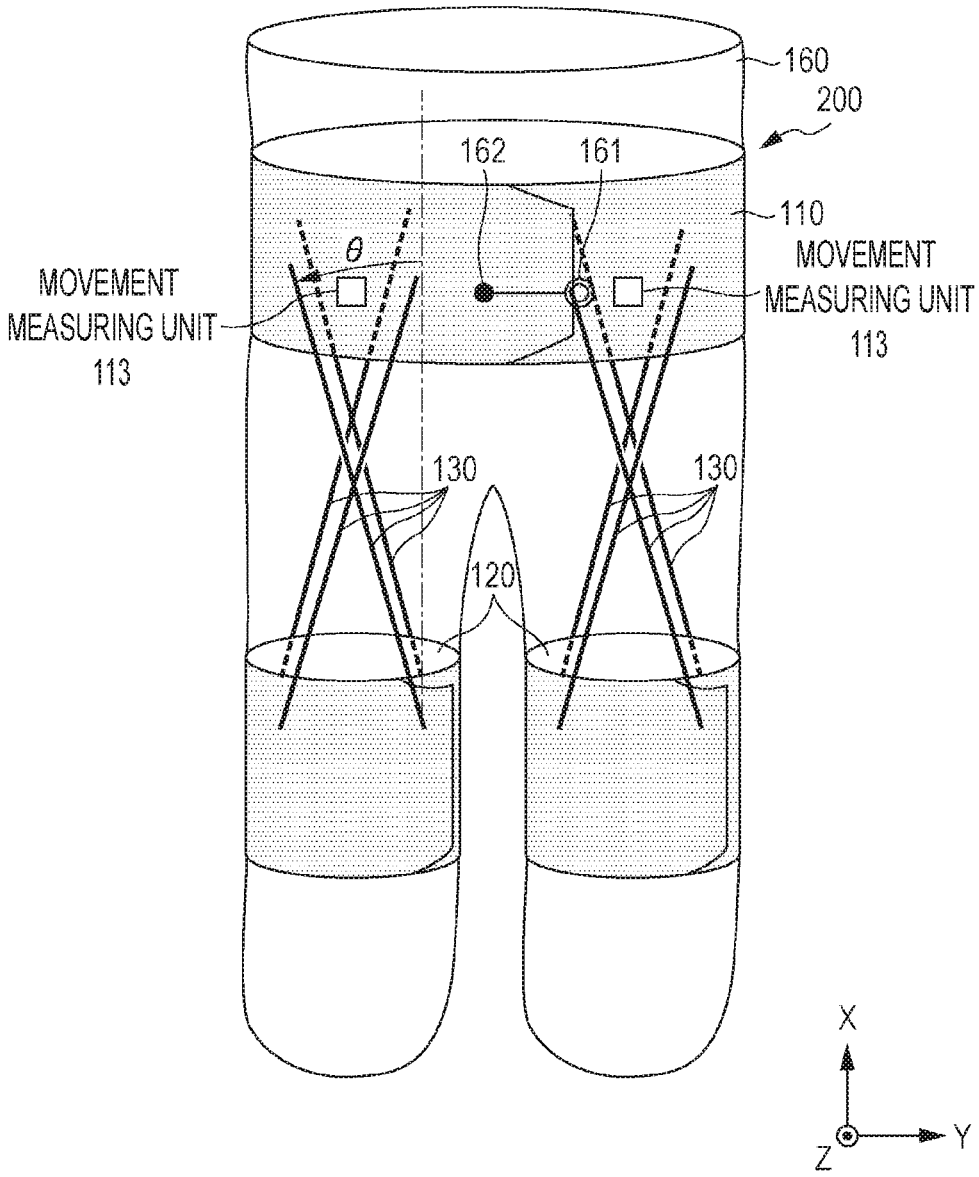
FIG. 22 illustrates the configuration in which the rotational component of the upper-body belt unit about the X-axis has a more noticeably effect at the time of calibration.
Figure 23:
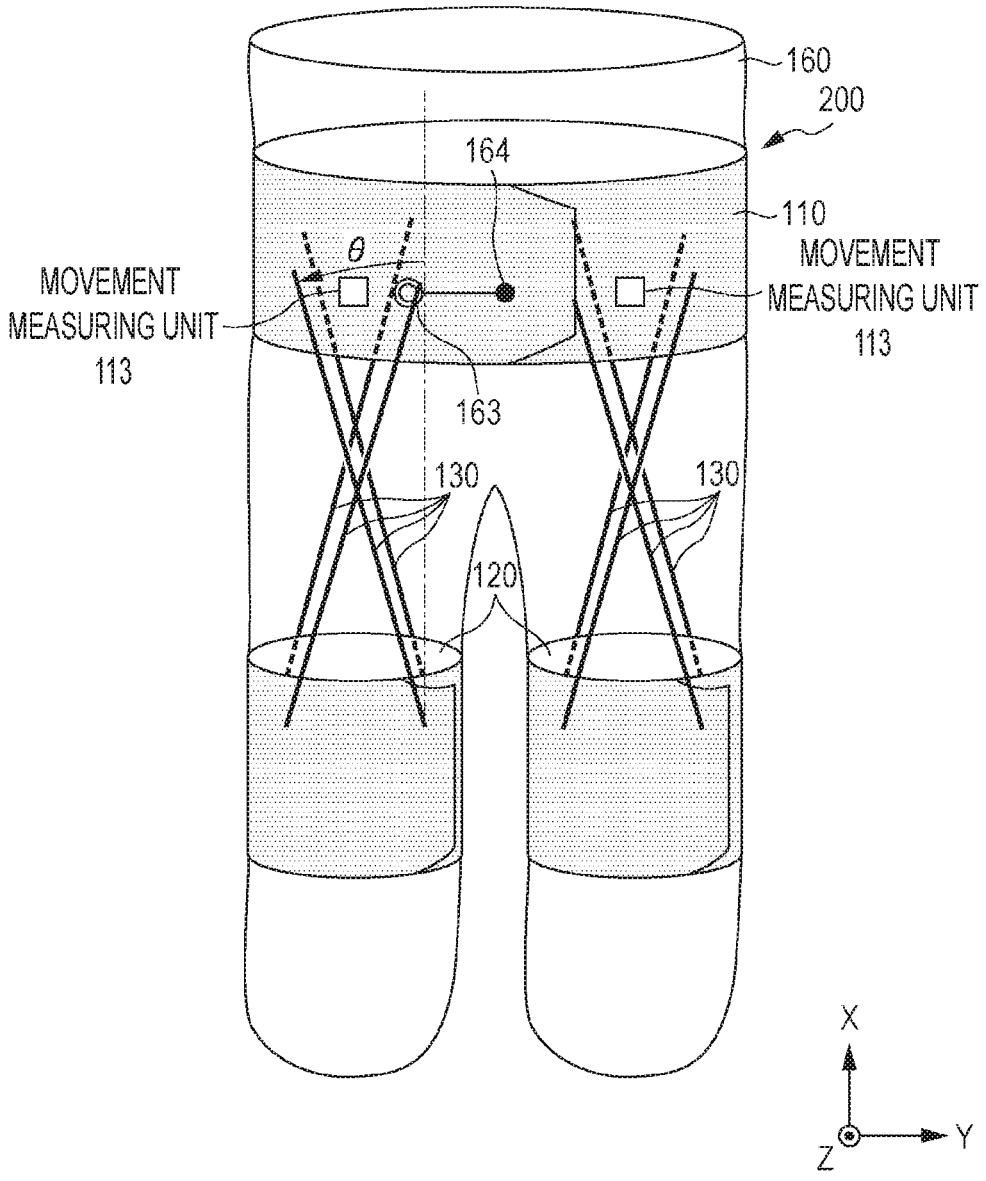
FIG. 23 illustrates the configuration in which the rotational component of the upper-body belt unit about the X-axis has a more noticeably effect at the time of calibration.

Furthermore, according to the present exemplary embodiment, in order to more noticeably calculate the rotational component about the X-axis of the upper-body belt unit 110 during the calibration when the method of the present disclosure is used in a wear-integrated assist suit, a technique illustrated in FIGS. 22 and 23 may be employed. That is, the wire 130 may be led from the knee belt unit 120 so as to pass through a ring-shaped supporting unit 161 provided on an inner wear item 160 and be attached to a fixed point 162 located on the upper-body belt unit 110 on the right rotation side of the supporting unit 161.

For example, to rotate the upper-body belt unit 110 counterclockwise, the wires "RF_right", "LF_right", "RR_left", and "LR_left" may be connected to the upper-body belt unit 110 as illustrated in FIG. 22. That is, the wires are led from the knee belt units 120 with tension at a predetermined angle so as to pass over the inner wear item 160. Thereafter, the wires are continuously led to the right of the user and are fixed to the upper-body belt unit 110. In this manner, by pulling the predetermined wires at the time of calibration, a more force is applied in the rotation direction about the X-axis. If the upper-body belt unit 110 is slack, the rotational displacement about the X-axis increases.

FIG. 23 illustrates a case where the upper-body belt unit is rotated clockwise. To rotate the upper-body belt unit clockwise, the wires "RF_left", "LF_left", "RR_right" and "LR_right" are pulled. When attaching the wires to the upper-body belt unit 110, the following technique may be employed. That is, the wires are led from the knee belt units 120 with tension at a predetermined angle so as to pass over the inner wear item 160. Thereafter, the wires are continuously led to the left of the user and are fixed to the upper-body belt unit 110. Note that if the supporting unit 161 and a supporting unit 163 are located at the same height as the fixed point 162 and a fixed point 164 (that is, the positions in the X-axis direction are the same), the largest force can be applied to the upper-body belt unit 110 in the longitudinal direction. For this reason, the position of the ring-shaped supporting units 161 and 163 and the position of the fixed points 162 and 164 in the X-axis direction may be set to the same position.

Examples of the structure of the supporting units 161 and 163 include the above-described annular ring, a pulley, and a rail. That is, the supporting units 161 and 163 slidably support the wires. By attaching, for example, a ring or a pulley to, for example, the inner wear item, a force in an oblique direction between the upper-body belt unit 110 and the knee belt unit 120 and a force in the longitudinal direction of the upper-body belt unit 110 are produced at the via point. While above description has been given with reference to the via point being a ring or a pulley, the via point is not limited thereto. For example, a string or thread may be threaded through the inner wear item, and the wire may be led so as to pass under the string or thread. Unlike the ring or pulley made of metal, the user is not injured by the string or thread even when the user touches the via point, since the string or thread is soft.

In the above description, to determine the connection points of the wires onto the upper-body belt unit 110, each of all of the four wires is led so as to pass through a via point and is continuously led to the left or right of the user after passing through the via point. However, the technique for determining the connection points is not limited thereto. For example, only one of the wires may be fixed in the above-described manner. This is because if at least one of the wires is fixed in the above-described manner, the rotational component about the X-axis increases at the time of calibration.

As described above, to connect the first wire to the upper-body belt unit 110, the first wire is led so as to pass through one point over the inner wear item 160 and, thereafter, the wire is led to the left or right of the user. Subsequently, the first wire is connected to the upper-body belt unit 110. That is, one end of the first wire is fixed to the motor 112 provided in the upper-body belt unit 110, and the other end is fixed to the knee belt unit 120. In addition, the upper-body belt unit 110 includes the supporting unit 161 or 163 for slidably supporting the first wire at a point between one end of the first wire and the other end. A part of the first wire between the one end of the first wire and the portion supported by the supporting unit 161 or 163 is located along the longitudinal direction of the upper-body belt unit 110. When detecting slacking of the upper-body belt unit 110, a force is applied in the longitudinal direction of the upper-body belt unit 110 by the tension of the motor 112.

Since a force in the rotation direction about the X-axis can be applied to the upper-body belt unit 110 more effectively, slacking of the upper-body belt unit 110 can be effectively detected.

Figure 24:
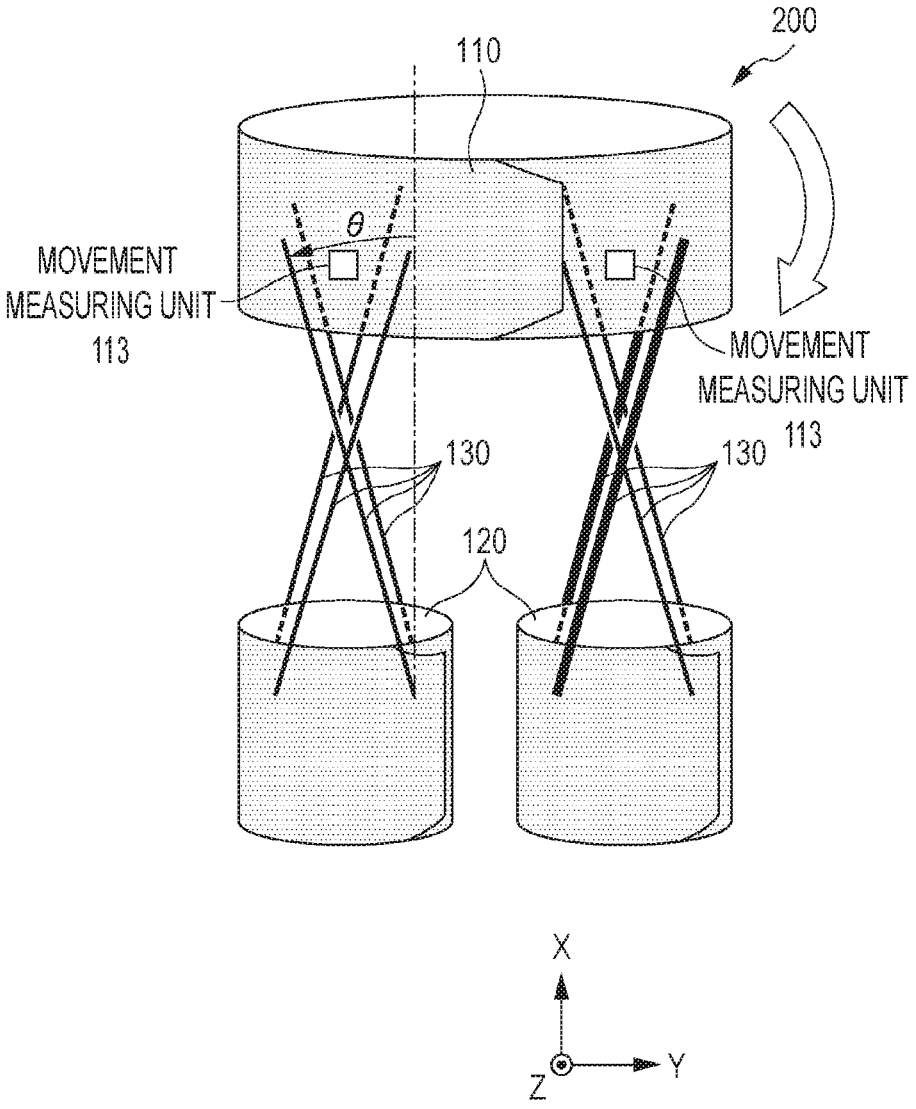
FIG. 24 illustrates the rotation of the upper-body belt unit about the Z-axis and a method for rotating the upper-body belt about the Z-axis.
Figure 25:
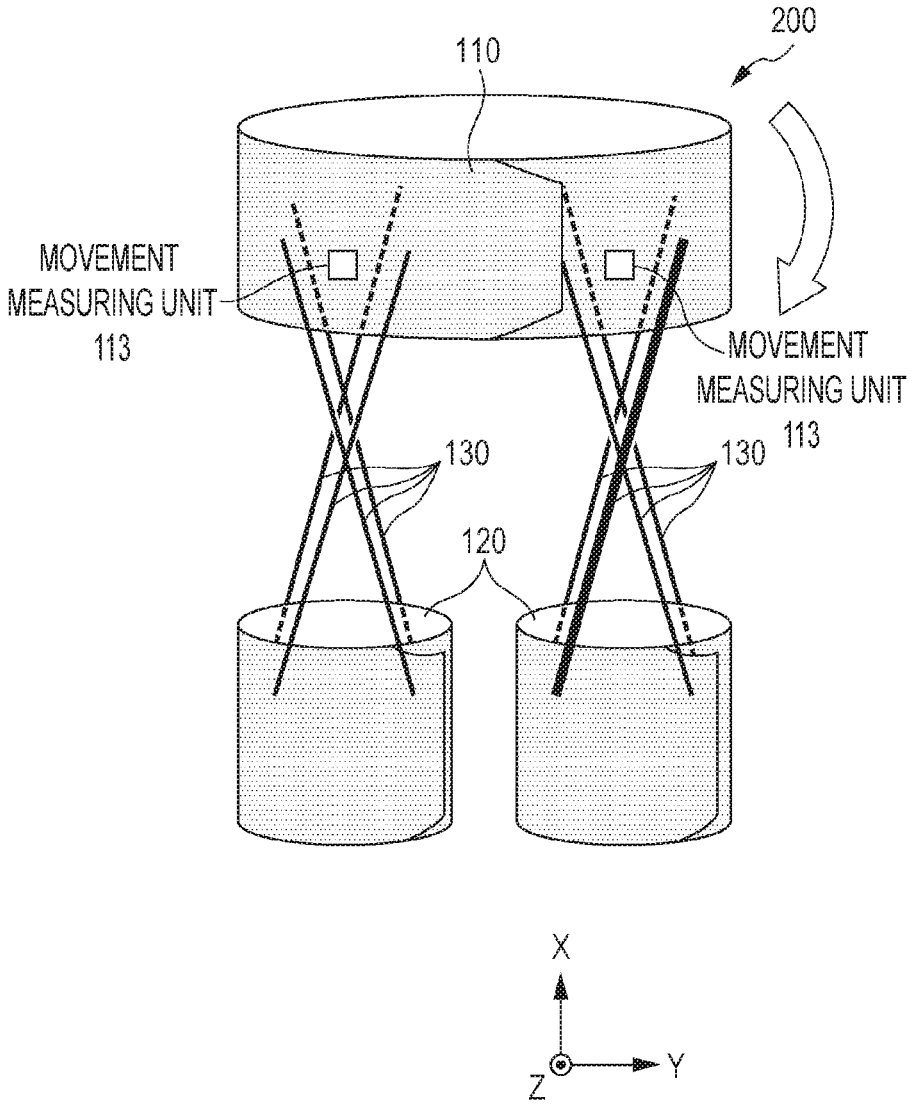
FIG. 25 illustrates the rotation of the upper-body belt unit about the Z-axis and a method for rotating the upper-body belt about the Z-axis.

The attachment position of the wire 130 to the movement measuring unit 113 for calculating the rotational component about the Z-axis is described below. To produce the rotational component about the Z-axis, two of the wires (for example, the wires "LF_left" and "LR_left") are pulled for each of the legs, instead of pulling the four wires as illustrated in FIG. 24. Thus, the left half of the upper-body belt unit 110 is easily rotated in the rotation direction about the Z-axis. Similarly, as illustrated in FIG. 25, by pulling one of the wires (for example, the wire "LF_left"), a rotational component about the Z-axis can be produced. At this time, to cause a larger rotation, it is effective to pull the wire "RF_right", "RR_right", "LF_left", or "LR_left" wire each having the attachment position on the outer side of the upper-body belt unit 110. Furthermore, in these cases, to calculate the rotation direction about the Z-axis more accurately, it is desirable that a movement measuring unit 113 be located at each of both ends of the upper-body belt unit 110.

Note that to produce the above-described rotational component about the Z-axis, the two wires that are the same as those used for assistance of abduction of the right and left legs are pulled. Accordingly, when this combination is used for calibration, displacement of the upper-body belt unit 110 in the rotational direction about the X-axis is detected by pulling the four wires, for example. If it is difficult to determine whether the upper-body belt unit 110 is slack (for example, if the displacement is substantially the same as the predetermined threshold value), an additional slack detection signal that selects the two wires may be sent. Then, slacking may be detected from the rotational component about the Z-axis.

Furthermore, at the time of calibration, both detection of the rotational displacement about the X-axis and detection of the rotational displacement about the Z-axis may be performed. If it can be determined that either one of the displacements is detected, the assist device 200 may instruct the user to tighten the upper-body belt unit 110 again.

According to the present exemplary embodiment, detection of slacking of the upper-body belt unit 110 by using a calibration signal is performed when the user wears the assist device 200 and when a certain period of time has elapsed or the user has walked a predetermined distance since the user wore the assist device 200. However, the time at which the detection is performed is not limited thereto. For example, calibration may be performed when the user turns right or left while walking, and it may be determined whether the upper-body belt unit 110 is slack. At this time, the direction in which the user turns (right/left and the angle) can be measured by using the movement measuring unit 113 provided in the upper-body belt unit 110.

Figure 26:
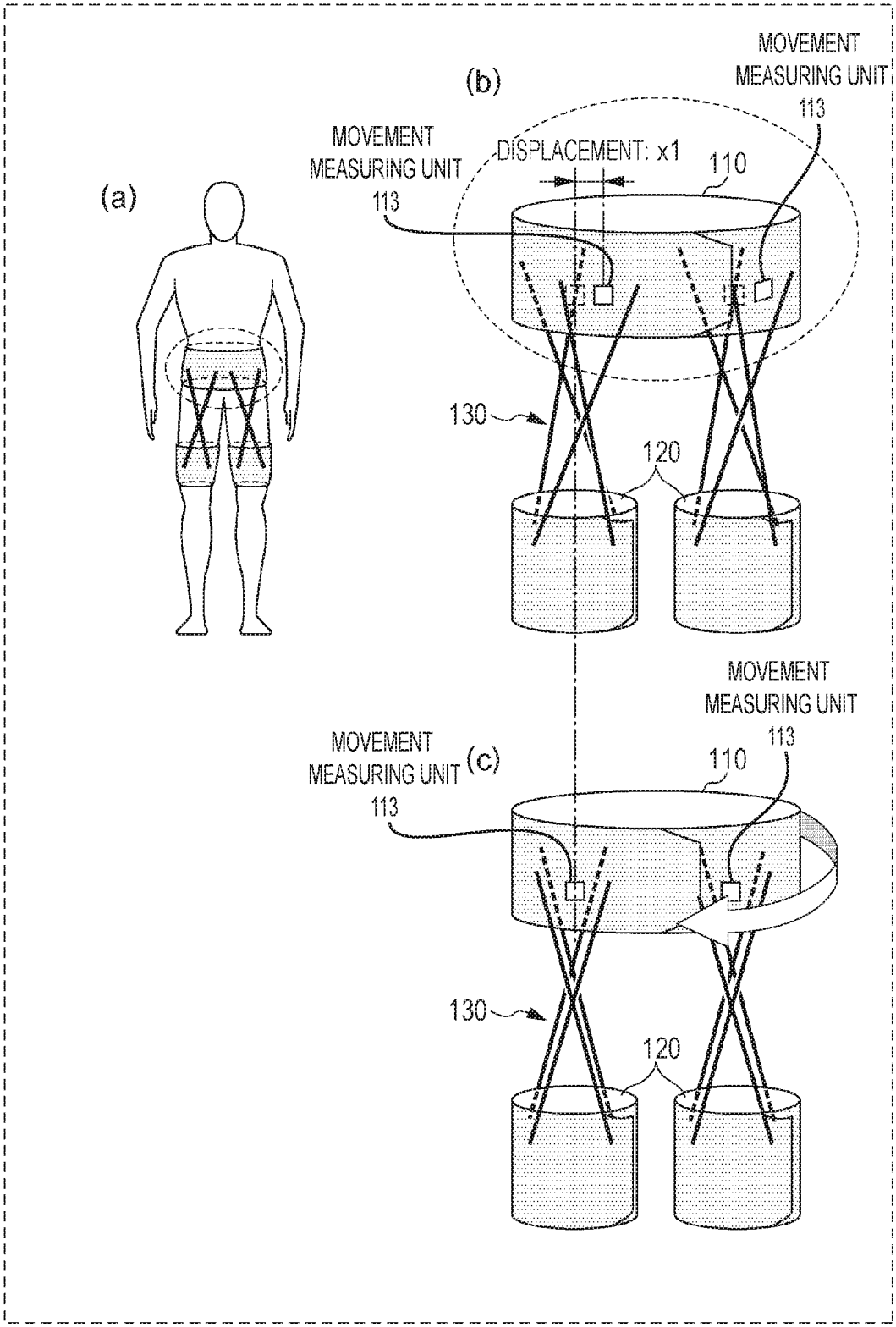
FIG. 26 illustrates the amount of movement (the displacement) of the upper-body belt unit in the case of detecting slacking of the upper-body belt unit in a normal state.
Figure 27:
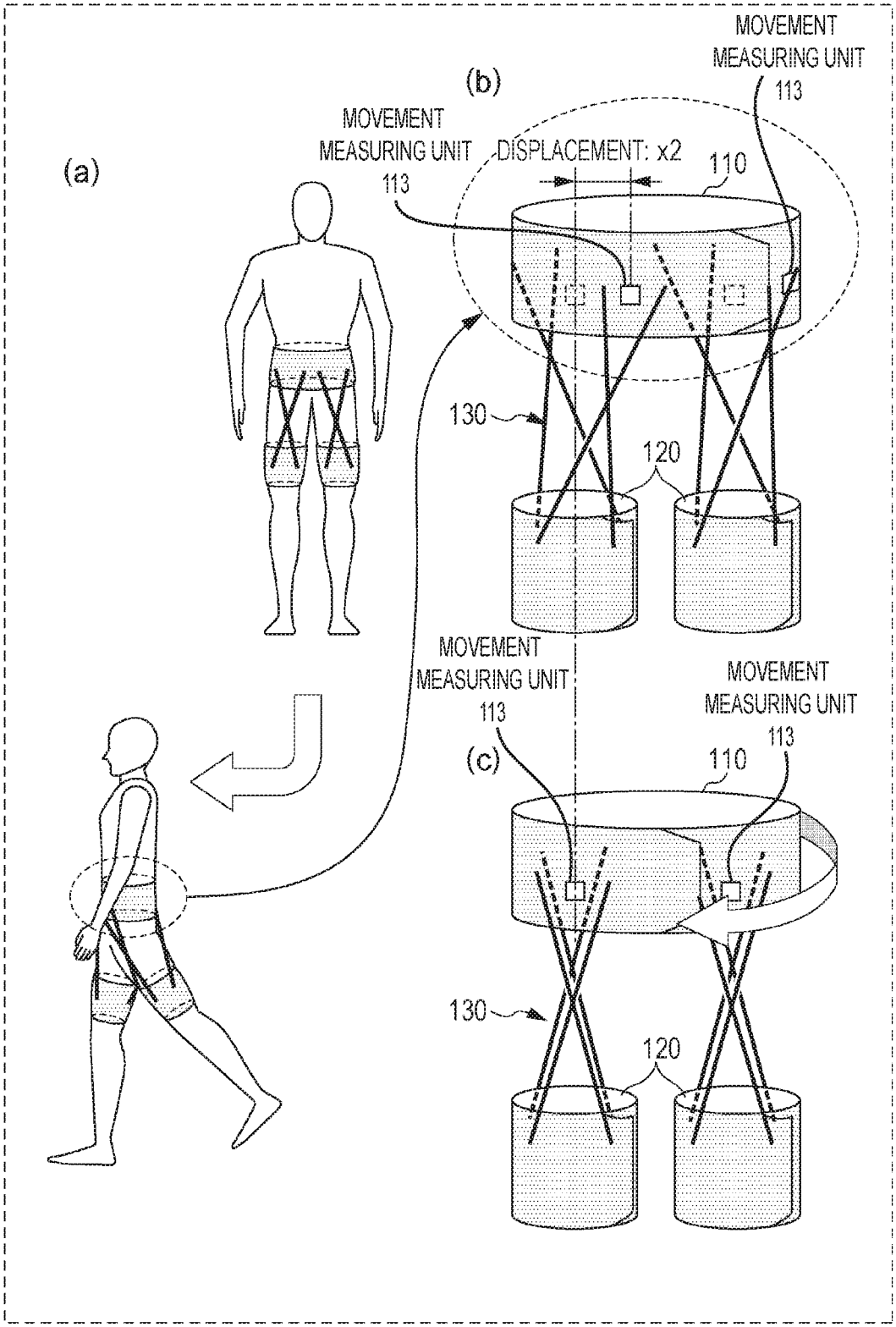
FIG. 27 illustrates the amount of movement (the displacement) of the upper-body belt unit in the case of detecting slacking of the upper-body belt unit when a user turns right while walking.

FIG. 26 illustrates the amount of movement (the displacement) of the upper-body belt unit in the case of detecting slacking of the upper-body belt unit in a normal state. FIG. 27 illustrates the amount of movement (the displacement) of the upper-body belt unit in the case of detecting slacking of the upper-body belt unit when the user turns right while walking.

FIG. 26(*a*) illustrates a user who is standing. FIGS. 26(*b*) and 26(*c*) illustrate the displacement of the upper-body belt unit 110 when a calibration signal for rotating the upper-body belt unit 110 in the clockwise direction is input to the four wires in order to detect slacking of the upper-body belt unit 110 while the user is standing. For example, a first tension is applied to each of the wires "RF_left", "LF_left", "RR_right", and "LR_right". When a calibration signal is input while the user is standing as illustrated in FIG. 26(*a*), the gyro sensor 115 that detects the angular velocity about the X-axis determines that the upper-body belt unit 110 rotates counterclockwise by a displacement x1.

FIG. 27(*a*) illustrates the user that turns right while walking. When the user turns right while walking, the waist of the user rotates counterclockwise with respect to the lower body. Accordingly, if the upper-body belt unit 110 is slack, the upper-body belt unit 110 rotates in the same manner as the rotation of the waist of the user who is turning, as illustrated in FIG. 27(*b*) and may not return afterwards. Accordingly, by, after the user turns right, pulling the wires, for example, the wires "RF_left", "LF_left", "RR_right", and "LR_right" in the clockwise direction as illustrated in FIG. 27(*c*), the upper-body belt unit 110 can be moved by a displacement x2 that is larger than x1. The gyro sensor 115 that detects the angular velocity about the X-axis can more effectively detect the amount of slack of the upper-body belt unit 110. Furthermore, the angle of right or left turn the user makes may be detected by using the acceleration sensor 114 and the gyro sensor 115 provided in the movement measuring unit 113 attached to the upper-body belt unit 110. Thereafter, by changing the tensions applied to the wires in accordance with the detected angle, the upper-body belt unit 110 may be returned to its original position.

While above description has been given with reference to calibration of the upper-body belt unit 110 performed in the case of turning right or left during walking, the time of calibration is not limited thereto. For example, calibration may be performed when the user walks up and down stairs. When the user walks up and down stairs, the height of leg lift is larger than during normal walking and, thus, the waist rotation is larger. As a result, the upper-body belt unit 110 is more likely to be displaced than during normal walking. Accordingly, calibration may be performed at every step. Alternatively, since calibration performed at every step imposes a burden to the user and causes energy loss, calibration may be performed after walking up the stairs or walking down the stairs.

As described above, every time a motion that may cause the upper-body belt unit 110 is displaced greatly is performed, the upper-body belt is rotated in a direction opposite to the expected direction in which the upper-body belt unit 110 is displaced. In this manner, slacking of the upper-body belt unit 110 can be detected more effectively.

1-1-5. Presentation Unit

The presentation unit 140 is a unit that presents, to the user, the result of determination made by the determination unit 102, that is, determination as to whether the upper-body belt unit 110 of the user is slack. More specifically, a vibration actuator is provided in the upper-body belt unit 110. If the determination unit 102 determines that the upper-body belt unit 110 is slack, the presentation unit 140 causes the vibration actuator to vibrate in a steady rhythm. In this manner, the presentation unit 140 may inform the user of slacking of the upper-body belt unit 110 and/or displacement of the attachment position. That is, the presentation unit 140 may be implemented by a vibration actuator. Note that the vibration pattern may be changed depending on whether the upper-body belt unit 110 is slack or the attachment position is displaced.

Even when the upper-body belt unit 110 is slack, the user may miss the notification unless vibration actuator vibrates greatly. Accordingly, for example, upon determining that the upper-body belt unit 110 is slack, the control unit 100 may change the tension of the wire 130 to 200 N and causes the vibration actuator to vibrate at 2 Hz. In contrast, even when the control unit 100 determines that the attachment position of the upper-body belt unit 110 is displaced, the upper-body belt unit 110 may not be slack. Accordingly, upon determining that the upper-body belt unit 110 is slack, the control unit 100 may decrease the tension of the wire 130 (for example, decreases the tension to 100 N) and causes the vibration actuator to vibrate at 5 Hz. Note that the vibration pattern is not limited thereto, and the user may set a desired vibration pattern by themselves.

While the above description has been given with reference to the presentation unit 140 that provides presentation to the user by using a vibration actuator provided in the upper-body belt unit 110, the configuration is not limited thereto. The vibration actuator may be provided on the knee belt unit 120. For example, in the case where the upper-body belt unit 110 is so slack that the user misses the vibration, the user may miss the vibration even when the vibration actuator provided on the upper-body belt unit 110 vibrates. Accordingly, by mounting the vibration actuator on the knee belt unit 120 that is less likely to be slack and vibrating the vibration actuator, the message indicating that the upper-body belt unit 110 is slack may be effectively presented to the user.

While the above description has been given with reference to the presentation unit 140 that presents, to the user, information indicating that the upper-body belt unit 110 is slack by vibrating the vibration actuator provided on the knee belt unit 120 or the upper-body belt unit 110 in accordance with the slack, the configuration is not limited thereto. For example, as illustrated in FIG. 3(*b*), the assist device 200 may present information on the mobile terminal 300, such as a smartphone carried by the user, by wirelessly communicating with the mobile terminal 300. That is, the presentation unit 140 may be implemented by the mobile terminal 300, which is an external device.

Figure 28:
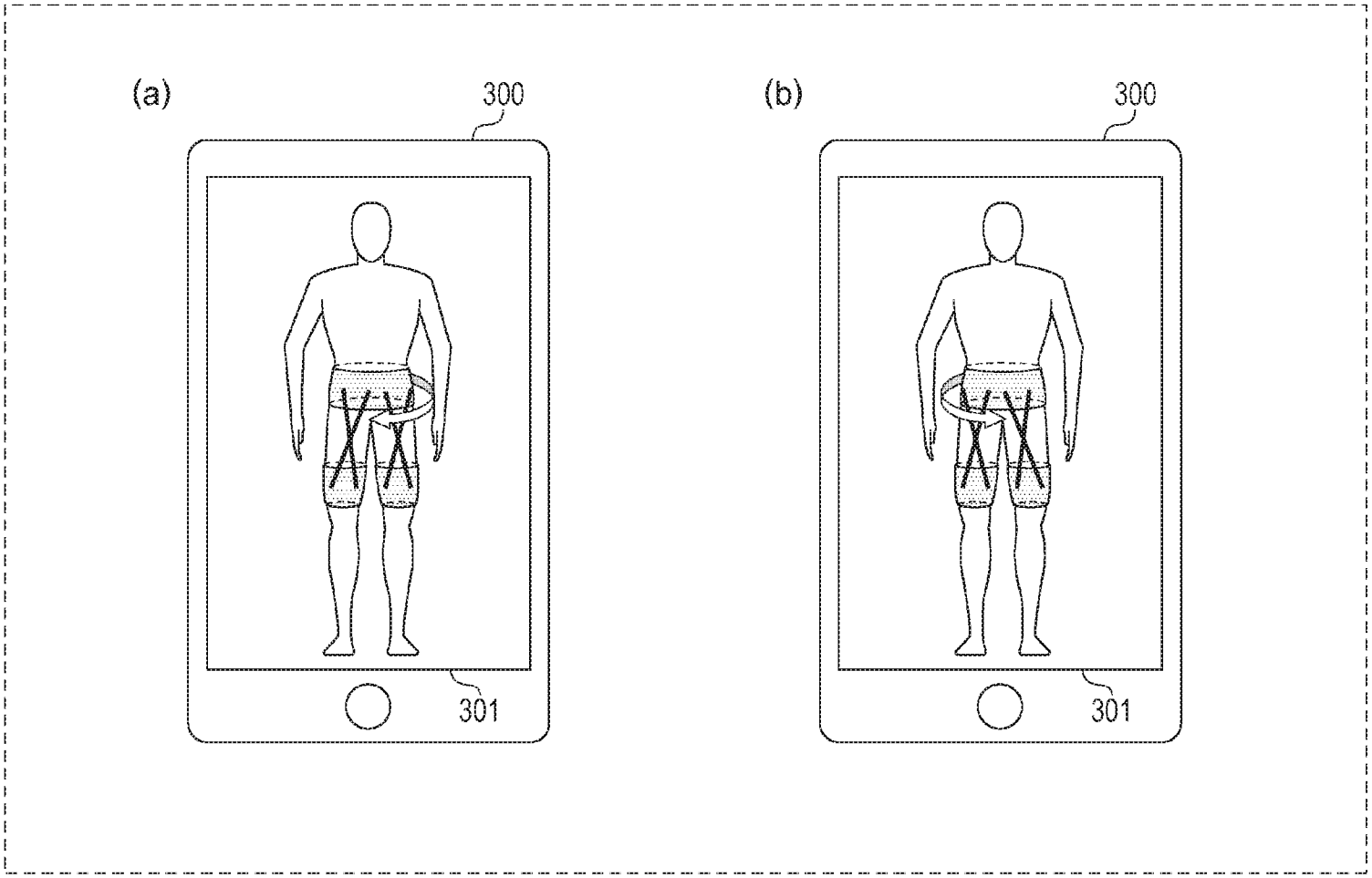
FIG. 28 illustrates an example of presentation of information to the user.

In addition, upon determining that the attachment position of the upper-body belt unit 110 is displaced, the control unit 100 may cause the mobile terminal 300 to present information representing an intuitive instruction to the user by using the image of the assist device 200, as illustrated in FIG. 28. FIG. 28 illustrates an example of presentation of the information to the user. FIG. 28(*a*) illustrates an example of information representing an instruction to rotate the upper-body belt unit 110 in the left rotational direction because it is determined that the upper-body belt unit 110 is displaced in the right rotational direction. FIG. 28(*b*) illustrates an example of information representing an instruction to rotate the upper-body belt unit 110 to in the right rotational direction because it is determined that the upper-body belt unit 110 is displaced in the left rotational direction. In this manner, by presenting, to the user, an instruction to prompt the user to move the attachment position to the proper position by using the image of the assist device 200, the user can intuitively understand in which direction the upper-body belt unit 110 is to be rotated to set the upper-body belt unit 110 at the proper position.

1-2. Operation

The operation performed by the assist device 200 is described below.

Figure 29:
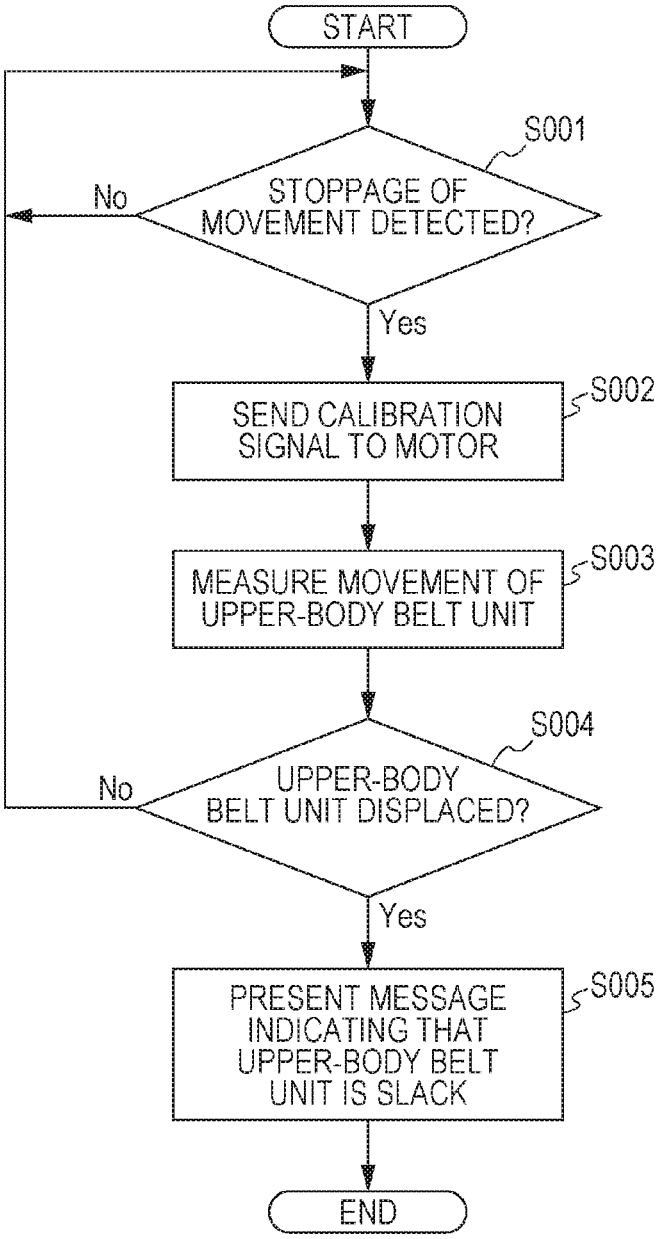
FIG. 29 is a flowchart illustrating the processing flow of the assist device according to the exemplary embodiment.

FIG. 29 is a flowchart illustrating the processing flow of the assist device 200 according to the present exemplary embodiment.

The movement measuring unit 113 detects that the movement of the user is stopped from the detection value of the acceleration sensor 114 (step S001). More specifically, the movement measuring unit 113 determines whether a period of time during which a change in acceleration measured by the acceleration sensor 114 is less than or equal to the second threshold value H continues for the predetermined period of time T. If the period of time during which a change in acceleration is less than or equal to the second threshold value H continues for the predetermined period of time T, the movement measuring unit 113 detects that the movement of the user is stopped. Otherwise, the movement measuring unit 113 detects that the movement of the user is not stopped.

Upon detecting that the movement of the user is stopped, the movement measuring unit 113 outputs a start signal to the control unit 100 and, thus, the calibration mode of the assist device 200 is started.

If the movement measuring unit 113 detects that the movement of the user is stopped (Yes in step S001), the calibration mode is started. The control unit 100 determines a calibration signal used to detect slacking of the upper-body belt unit 110 by using the signal input unit 101 and sends the signal to the drive control unit 111 (step S002). Thus, upon receiving the calibration signal, the drive control unit 111 drives the motor 112 to pull the wires 130 in accordance with the calibration signal. As a result, a tension (the first tension) is applied to the upper-body belt unit 110.

Subsequently, the movement measuring unit 113 measures the movement of the upper-body belt unit 110 when the first tension is applied to the upper-body belt unit 110 via the wires 130 (step S003). The movement measuring unit 113 may measure the movement of the upper-body belt unit 110 in a predetermined period before the first tension is applied or may measure the movement of the upper-body belt unit 110 at all times when the assist device 200 is activated.

The determination unit 102 determines whether the upper-body belt unit 110 is slack by determining whether a predetermined condition is satisfied (step S004). The predetermined condition includes at least one of the following conditions:

(a) A change in the magnitude of the acceleration in the Y-axis direction is greater than or equal to a predetermined threshold value.

(b) A change in the magnitude of the angular velocity about the X-axis is greater than or equal to a predetermined threshold value.

(c) A change in the magnitude of the angular velocity about the Z-axis is greater than or equal to a predetermined threshold value.

(d) A change in the magnitude of the acceleration in the Y-axis direction is greater than or equal to a predetermined threshold value, and a change in the magnitude of the angular velocity about the X-axis is greater than or equal to a predetermined threshold value.

If the determination unit 102 determines that the attachment position of the upper-body belt unit 110 is not displaced, the determination unit 102 determines that the upper-body belt unit 110 is not slack (No in step S004). Thus, the processing returns to step S001.

However, if the determination unit 102 determines that the attachment position of the upper-body belt unit 110 is displaced (Yes in step S004), the control unit 100 presents, to the user, information indicating that the upper-body belt unit 110 is slack by using the presentation unit 140 (step S005).

1-3. Effects

According to the present exemplary embodiment, the assist device 200 is an assist device that assists the hip joint of a user, and wires used for the assistance are disposed so as to cross each other. Since the wires are disposed so as to cross each other, the assist device 200 can assist the user with the extension, flexion, abduction, adduction, external rotation, and internal rotation of the hip joint. At the same time, the assist device 200 can detect slacking of the upper-body belt unit 110 of the assist device 200 effectively.

That is, when the user wears the assist device 200, the assist device 200 determines whether the upper-body belt unit 110 is slack from the variation width detected by the acceleration sensor 114 or the gyro sensor 115 provided in the upper-body belt unit 110. If the assist device 200 determines that the upper-body belt unit 110 is slack, the assist device 200 presents, to the user, information regarding the result of determination. Thus, the user can refasten the upper-body belt unit 110 in an appropriate manner. As a result, when the user wears the assist device 200, the slack and the displacement of the upper-body belt unit 110 can be reduced and, thus, the user can receive a more effective assisting force from the assist device 200.

1-4. Modifications

1-4-1. First Modification

Figure 30:
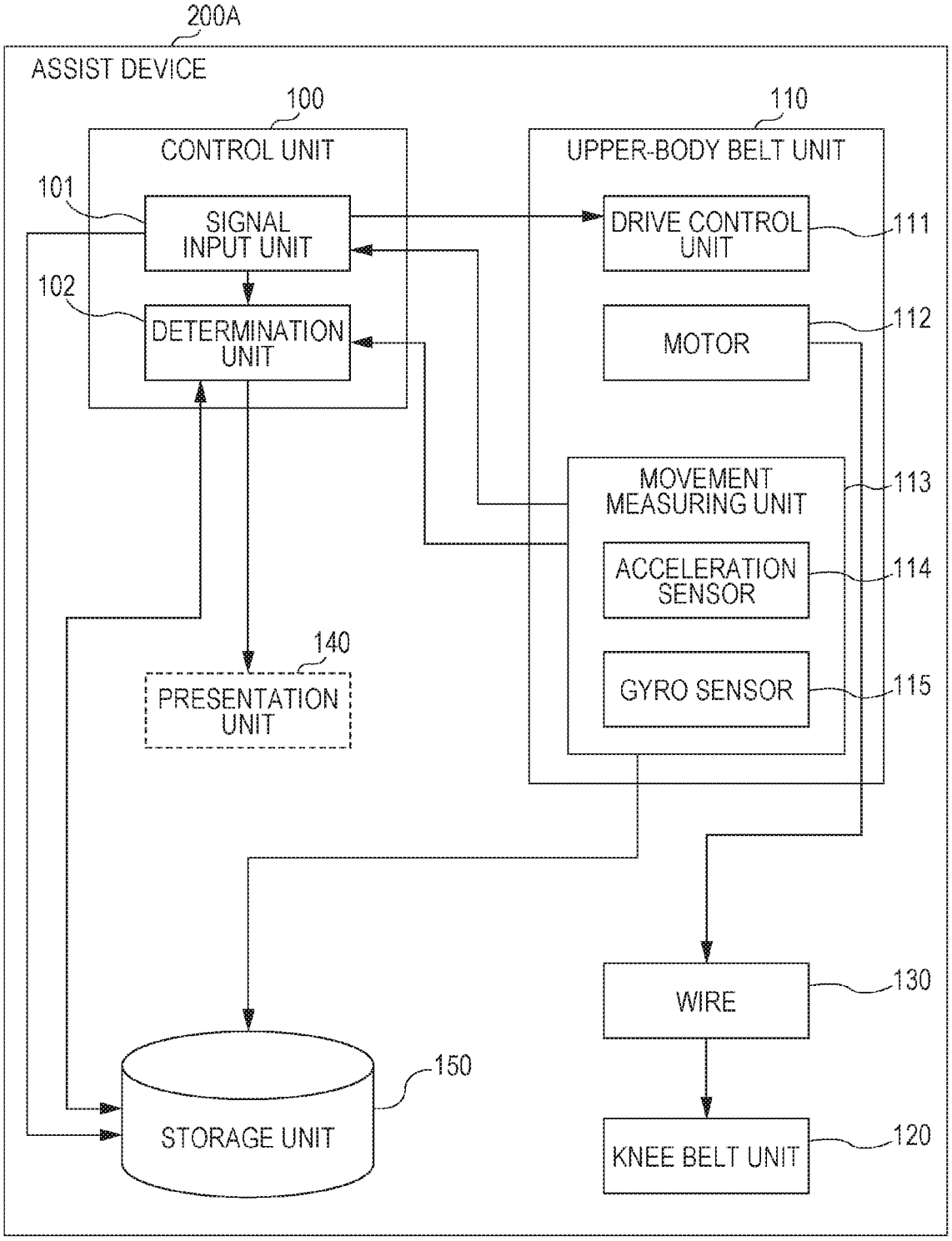
FIG. 30 is a block diagram of the configuration of an assist device according to a first modification.

As a modification of the present exemplary embodiment, an assist device 200A may be employed. The assist device 200A includes a storage unit 150 in addition to the configuration of the assist device 200 according to the present exemplary embodiment. FIG. 30 is a block diagram of the configuration of the assist device 200A according to a first modification.

Each time the user uses the assist device 200, the storage unit 150 stores user information, a calibration signal received from the signal input unit 101, the values of acceleration and angular velocity measured by the movement measuring unit 113 in response to the input signal, and the result of determination made by the determination unit 102. When the user uses the assist device 200A a second and subsequent times, the determination unit 102 compares the calibration signal and the values of the acceleration and the angular velocity stored in the storage unit 150 with the result of determination made at the time of past attachment. If both are the same, the determination in the past may be employed.

In addition, as described above, by storing, for the same user, the values from the movement measuring unit 113 in the storage unit 150 and comparing the stored data with the data in the past, the user can obtain new information, such as information as to whether the slack of the belt increases as compared with data in the past or information indicating that the slack occurs and the belt is displaced due to the slack although the slack does not increase as compared with data in the past. As a result, the user can sensuously find out the particular fit of the upper-body belt unit 110.

As described above, by using the storage unit 150, different patterns according to individual users or different patterns for the same user according to different slacks of the upper-body belt unit 110 due to the clothing on that day can be stored. Thus, slacking of the knee belt unit can be detected more accurately. In addition, some users misplace the attachment positions in the same way every time the users wear the upper-body belt unit 110. In this case, by causing the assist device to learn the pattern of the attachment position displacement for the user by using the storage unit 150, the assist device can alert the user of the displacement each time the user wears the upper-body belt unit 110 and, thus, the assist device can properly assist the user from the beginning of attachment.

1-4-2. Second Modification

While the present exemplary embodiment has been described with reference to slacking of the upper-body belt unit 110 detected when the user is standing, detection of slacking is not limited thereto. Slacking may be detected when the user remains sitting. For example, in the case where the user wearing the assist device 200 is an elderly person, the user wears the assist device 200 after sitting on a chair, in general. Accordingly, when slacking of the upper-body belt unit 110 is detected immediately after the user wears the assist device 200, the detection of slacking of the upper-body belt unit 110 needs to be made while the user is sitting on a chair.

Figure 31:
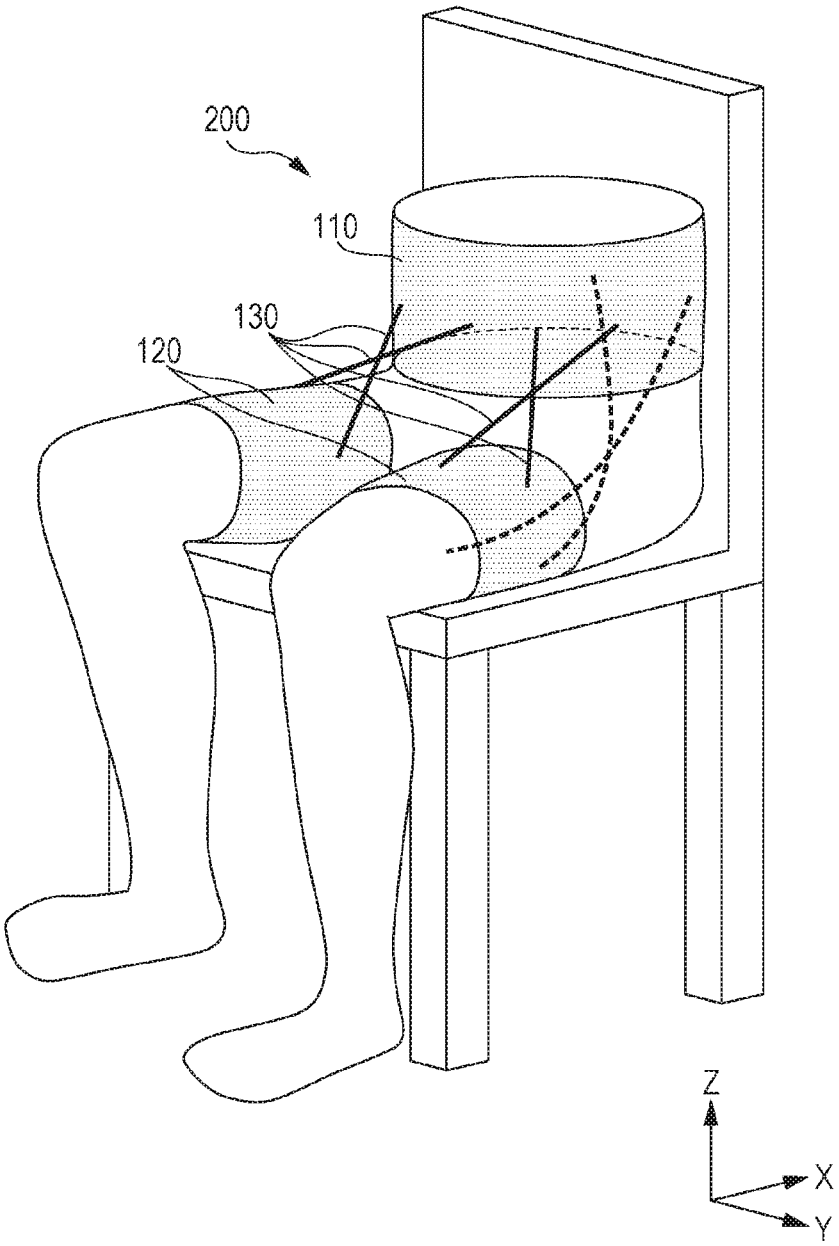
FIG. 31 illustrates determination of the fit of the upper-body belt unit when the user remains sitting.

FIG. 31 illustrates determination of the fit of the upper-body belt unit when the user remains sitting. The wires 130 disposed so as to cross each other are set under assumption of the user that is standing. Accordingly, when the user is standing and if the wires are pulled in order to rotate the upper-body belt unit 110, a rotational component is generated by each of the wires. For example, the tensions of the wires "RF_right" and "LF_right" generate a force acting in the counterclockwise rotational direction. In addition, the tensions of the wires "RF_left" and "LF_left" generate a force acting in the clockwise rotational direction. In this manner, slacking of the upper-body belt unit 110 can be detected.

However, as illustrated in FIG. 31, when the user is sitting, the direction in which the wires pull the upper-body belt unit 110 is changed from that when the user is standing and, thus, the force of the rotational component is reduced. For example, many users open their legs when sitting. At this time, for example, the wires "RF_right" and "LF_left" exert tension in the front-rear direction of the user. That is, the component that produces the rotation of the upper-body belt unit 110 is reduced. On the other hand, each of the angles of the wires "RF_left" and "LF_right" with respect to the right-left direction of the upper-body belt unit 110 increases, as compared with when the user is standing. Consequently, the component that rotates the upper-body belt unit 110 is increased. Accordingly, for example, when calibration is performed while the user is sitting, slacking of the upper-body belt unit 110 may be detected by pulling only one of the wires "RF_left" and "LF_right" with a predetermined tension, for example, a tension of 100 N.

In addition, when the user remains sitting, the rear side of the upper-body belt unit 110 is in contact with, for example, a chair. Accordingly, friction, for example, occurs when the wires are pulled, so that tension is not completely transferred. For this reason, as described above, when the user is sitting, calibration may be performed by using only the wires "RF_left" and "LF_right" on the front side. In the coordinates when the user is sitting, the front-rear direction of the user is defined as the X-axis direction, the right-left direction of the user is defined as the Y-axis direction, and the vertical direction of the user is defined as the Z-axis direction. When the user is sitting, one side (the lower side) of each of the legs of the user is in contact with the chair, and one side of the waist (the rear side) is in contact with the chair. Accordingly, in the region on the rear side of the user, even when the wires are pulled, the upper-body belt unit 110 negligibly moves due to a frictional force, regardless of whether the upper-body belt unit 110 is slack or tightened. In contrast, in the region on the front side of the user, by pulling, in particular, the wires "RF_left" and "LF_right", the upper-body belt unit 110 is moved in the rotation direction about the Z-axis if the upper-body belt unit 110 is slack. At this time, since the upper-body belt unit 110 is in contact with the chair, the movement of the upper-body belt unit 110 is slowed down due to a frictional force. In addition, it is unlikely that the upper-body belt unit 110 returns to its original position by the backlash that occurs when the upper-body belt unit 110 is moved vigorously.

Accordingly, when the user is sitting, the determination unit 102 calculates the displacement about the Z-axis from the value obtained from the movement measuring unit 113. If the displacement value is greater than or equal to a predetermined threshold value (for example, 0.05 to 0.5 rad), the determination unit 102 may determine that the upper-body belt unit 110 is slack. Note that it is determined whether the user is sitting or standing by using the value output from the acceleration sensor provided in the movement measuring unit 113. If the value from the acceleration sensor contains, for example, at least 70 percent gravity component in the X-axis direction of the acceleration sensor, it is determined that the user is standing. If the value from the acceleration sensor contains, for example, at least 70 percent gravity component in the Z-axis direction of the acceleration sensor, it is determined that the user is sitting.

1-4-3. Third Modification

In addition, according to the present exemplary embodiment, the control unit 100 determines whether the upper-body belt unit 110 is slack and presents to the user, information indicating that the upper-body belt unit 110 is slack and/or displaced by, for example, vibrating the upper-body belt unit 110. However, the information is not limited thereto. For example, the control unit 100 may automatically tighten the upper-body belt unit 110 so as to eliminate slack in accordance with the slack. In addition, the control unit 100 may rotate the upper-body belt unit 110 in order to correct the displacement of the attachment position of the upper-body belt unit 110 and place the upper-body belt unit 110 in position. Furthermore, at this time, the control unit 100 may adjust the fit of the upper-body belt unit 110 in accordance with the amount of slack measured by the movement measuring unit 113. In this manner, the assist device 200 can tighten the upper-body belt unit 110 so that the upper-body belt unit 110 is not displaced without the user feeling pain caused by overtightening.

1-4-4. Fourth Modification

While above description has been given with reference to the movement measuring unit 113 that make determination as to whether calibration is to be started, the determination need not be made by the movement measuring unit 113. For example, the determination unit 102 of the control unit 100 may made the determination. In this case, the determination unit 102 may receive the acceleration and the angular velocity of the upper-body belt unit 110 from the movement measuring unit 113 in real time and determine whether to start calibration by using the received acceleration and angular velocity values. That is, the determination unit 102 may further determine whether the acceleration measured by the acceleration sensor 114 of the upper-body belt unit 110 is less than or equal to a second threshold value. If the acceleration measured by the acceleration sensor 114 is less than or equal to the second threshold value and the angular velocity measured by the gyro sensor 115 is greater than or equal to the first threshold value, the determination unit 102 may output information indicating that the upper-body belt unit 110 is slack or information indicating that the upper-body belt unit 110 is displaced.

Accordingly, when the user stops their movement, the information indicating that the upper-body belt unit 110 is slack or the information indicating that the upper-body belt unit 110 is displaced can be output and, thus, the information can be more effectively output to the user. That is, by vibrating the vibration actuator serving as the presentation unit 140 when the user stops their movement, the information indicating that the upper-body belt unit 110 is slack or the information indicating that the upper-body belt unit 110 is displaced can be delivered to the user more effectively than when the user is making a movement.

Note that if the acceleration measured by the acceleration sensor 114 is less than or equal to the second threshold value, the determination unit 102 may output, to the drive control unit 111, information indicating that the acceleration measured by the acceleration sensor 114 is less than or equal to the second threshold value.

1-4-5. Fifth Modification

While the above embodiment has been described with reference to the upper-body belt unit 110 and the knee belt units 120 formed as separate bodies, the configuration is not limited thereto. For example, the upper-body belt unit 110 may be connected to the knee belt units 120 and are integrated into a form of pants (shorts).

1-5. Other Embodiments

According to the above-described exemplary embodiments, each of the constituent elements may be configured by using dedicated hardware or execution of a software program suitable for the constituent element. Each of the constituent elements may be implemented by a program execution unit, such as a central processing unit (CPU) or a processor, reading out and executing a software program recorded on a recording medium, such as a hard disk or a semiconductor memory. The software that enables the assist method according to the above-described exemplary embodiment is a program described below.

That is, the program causes a computer to perform an assist method in an assist device including an upper-body belt attached to an upper body of a user, a first belt attached to the right knee of the user, a second belt attached to the left knee of the user, a first wire that connects the upper-body belt to the first belt, a second wire that connects the upper-body belt to the first belt and that is disposed so as to cross the first wire, a third wire that connects the upper-body belt to the second belt, a fourth wire that connects the upper-body belt to the second belt and that is disposed so as to cross the third wire, and a motor connected to the first wire, the second wire, the third wire, and the fourth wire. The assist method includes (a) applying a tension greater than or equal to the first threshold value to one of the first wire and the second wire and one of the third wire and the fourth wire by using the motor at different points in time when assisting the user with walking and (b) applying a tension greater than or equal to the first threshold value to one of the first wire and the second wire and one of the third wire and the fourth wire by using the motor at the same time when detecting slacking of the upper-body belt.

According to the present disclosure, all or some of the units, apparatuses, members or parts, or all or some of the functional blocks in the block diagram illustrated in FIG. 2 or FIG. 23 may be configured by using a semiconductor device, a semiconductor integrated circuit (IC), or at least one electronic circuit including a large scale integration (LSI). The LSI or the IC may be integrated into one chip or may be formed by combining a plurality of chips. For example, functional blocks other than a memory element may be integrated into one chip. The terms "LSI" and "IC" are used herein, but the terms "system LSI", VLSI (very large scale integration), or ULSI (ultra large scale integration) may be used as well depending on the level of integration. Alternatively, a field programmable gate array (FPGA), which is programmable after fabrication of the LSI, or a reconfigurable logic device which allows reconfiguration of connections and settings of circuit cells in LSI may be used for the same purpose.

Furthermore, the functions or operations of all or some of the units, devices, or parts of devices can be performed by software processing. In this case, the software is recorded on one or more non-transitory recording media, such as ROMs, optical disks, and hard disk drives. When the software is executed by a processor, the function identified by the software is performed by the processor and peripheral devices. The system or device may include one or more non-transitory recording media on which the software is recorded, a processor, and a required hardware device (e.g., an interface).

While the assist device and the assist method according to one or more aspects of the present disclosure have been described with reference to the exemplary embodiments, the present disclosure is not limited to the exemplary embodiments. A variety of modifications of the present exemplary embodiments that are conceivable by those skilled in the art and an embodiment configured by combining constituent elements of different embodiments may be encompassed in the spirit and scope of the present disclosure.

The present disclosure is useful for an assist device that assists a person with motion by using wires and that can effectively detect slacking of a belt of the assist device.

What is claimed is:

1. An assist device comprising:

an upper-body belt to be attached to an upper body of a user;

a first belt to be attached to a right knee of the user;

a second belt to be attached to a left knee of the user;

a first wire that couples the upper-body belt to the first belt;

a second wire that couples the upper-body belt to the first belt, the second wire crossing the first wire;

a third wire that couples the upper-body belt to the second belt;

a fourth wire that couples the upper-body belt to the second belt, the fourth wire crossing the third wire;

a motor coupled to a first end of the first wire, a terminal end of the second wire, a terminal end of the third wire, and a terminal end of the fourth wire;

a sensor; and a drive controller that (i) causes the motor to apply a first tension greater than or equal to a first threshold value to one of the first wire and the second wire at a first time and a second tension greater than or equal to the first threshold value to one of the third wire and the fourth wire at a second time different from the first time when the assist device assists the user with walking and (ii) causes the motor to apply a third tension greater than or equal to the first threshold value to one of the first wire and the second wire at a third time and a fourth tension greater than or equal to the first threshold value to one of the third wire and the fourth wire at the third time when the assist device detects slacking of the upper-body belt using the sensor.

2. The assist device according to claim 1, further comprising:

a second controller, wherein the sensor is a gyro sensor disposed at the upper-body belt, the gyro sensor configured to measure an angular velocity about a vertical axis of the user, wherein the gyro sensor measures the angular velocity when a tension greater than or equal to the first threshold value is applied to one of the first wire and the second wire at a fourth time and one of the third wire and the fourth wire at the fourth time, and wherein the second controller outputs information indicating that the upper-body belt is slack if the angular velocity is greater than or equal to a second threshold value.

3. The assist device according to claim 1, wherein the first wire is parallel to the third wire, and the second wire is parallel to the fourth wire, and wherein when the assist device detects the slacking, the drive controller causes the motor to apply the third tension to the first wire at the third time and the fourth tension to the third wire at the third time or applies the third tension to the second wire at the third time and the fourth tension to the fourth wire at the third time.

4. The assist device according to claim 1, further comprising:

a fifth wire that couples the upper-body belt to the first belt;

a sixth wire that couples the upper-body belt to the first belt, the sixth wire crossing the first wire;

a seventh wire that couples the upper-body belt to the second belt; and an eighth wire that couples the upper-body belt to the second belt, the eighth wire crossing the seventh wire, wherein the first wire, the second wire, the third wire, and the fourth wire are configured to be located on a front side of the user, and the fifth wire, the sixth wire, the seventh wire, and the eighth wire are configured to be located on a rear side of the user, wherein the first wire is parallel to each of the third wire, the fifth wire, and the seventh wire, and the second wire is parallel to each of the fourth wire, the sixth wire, and the eighth wire, and wherein the assist device is configured to assist the user with one of adduction and abduction of a leg of the user by performing any one of the following operations:

(a1) the drive controller causes the motor to apply a tension greater than or equal to the first threshold value to each of the first wire and the fifth wire;

(a2) the drive controller causes the motor to apply a tension greater than or equal to the first threshold value to each of the second wire and the sixth wire;

(a3) the drive controller causes the motor to apply a tension greater than or equal to the first threshold value to each of the third wire and the seventh wire; and (a4) the drive controller causes the motor to apply a tension greater than or equal to the first threshold value to each of the fourth wire and the eighth wire.

5. The assist device according to claim 4, wherein the assist device is configured to assist the user with one of internal rotation and external rotation of the leg by performing any one of the following operations:

(b1) the drive controller causes the motor to apply a tension greater than or equal to the first threshold value to each of the first wire and the sixth wire;

(b2) the drive controller causes the motor to apply a tension greater than or equal to the first threshold value to each of the second wire and the fifth wire;

(b3) the drive controller causes the motor to apply a tension greater than or equal to the first threshold value to each of the third wire and the eighth wire; and (b4) the drive controller causes the motor to apply a tension greater than or equal to the first threshold value to each of the fourth wire and the seventh wire.

6. The assist device according to claim 1, wherein the first wire has the first end and a second end, wherein the motor is disposed at the upper-body belt, wherein the second end is fixed to the first belt, wherein the upper-body belt includes a supporter that slidably supports the first wire, and a first portion of the first wire located between the first end of the first wire and the supporter extends in a longitudinal direction of the upper-body belt, and wherein when the slacking of the upper-body belt is detected, the motor applies a force to the first portion of the first wire.

7. An assist method for use of an assist device, the assist device including an upper-body belt to be attached to an upper body of a user, a first belt to be attached to a right knee of the user, a second belt to be attached to a left knee of the user, a first wire that couples the upper-body belt to the first belt, a second wire that couples the upper-body belt to the first belt and that crosses the first wire, a third wire that couples the upper-body belt to the second belt, a fourth wire that couples the upper-body belt to the second belt and that crosses the third wire, a sensor, and a motor coupled to the first wire, the second wire, the third wire, and the fourth wire, the method comprising:

(a) causing the motor to apply a first tension greater than or equal to a first threshold value to one of the first wire and the second wire at a first time and a second tension greater than or equal to the first threshold value to one of the third wire and the fourth wire at a second time different from the first time when the assist device assists the user with walking; and (b) causing the motor to apply a third tension greater than or equal to the first threshold value to one of the first wire and the second wire at a third time and a fourth tension greater than or equal to the first threshold value to one of the third wire and the fourth wire at the third time when the assist device detects slacking of the upper-body belt using the sensor.

8. The assist method according to claim 7, wherein the sensor is a gyro sensor.

9. A non-transitory computer-readable recording medium storing a control program that causes a device including a processor to perform a process, the control program being used in an assist device including an upper-body belt to be attached to an upper body of a user, a first belt to be attached to a right knee of the user, a second belt to be attached to a left knee of the user, a first wire that couples the upper-body belt to the first belt, a second wire that couples the upper-body belt to the first belt and that crosses the first wire, a third wire that couples the upper-body belt to the second belt, a fourth wire that couples the upper-body belt to the second belt and that crosses the third wire, a sensor, and a motor coupled to the first wire, the second wire, the third wire, and the fourth wire, the process comprising:

(a) causing the motor to apply a first tension greater than or equal to a first threshold value to one of the first wire and the second wire at a first time and a second tension greater than or equal to the first threshold value to one of the third wire and the fourth wire at a second time different from the first time when the assist device assists the user with walking; and (b) causing the motor to apply a third tension greater than or equal to the first threshold value to one of the first wire and the second wire at a third time and a fourth tension greater than or equal to the first threshold value to one of the third wire and the fourth wire at the third time when the assist device detects slacking of the upper-body belt using the sensor.

10. The recording medium according to claim 9, wherein the sensor is a gyro sensor.

* * * * *